US011350230B2

(12) United States Patent
Eronen et al.

(10) Patent No.: US 11,350,230 B2
(45) Date of Patent: May 31, 2022

(54) SPATIAL SOUND RENDERING

(71) Applicant: Nokia Technologies Oy, Espoo (FI)

(72) Inventors: Antti Eronen, Tampere (FI); Mikko-Ville Laitinen, Helsinki (FI); Juha Vilkamo, Helsinki (FI); Lasse Laaksonen, Tampere (FI); Anssi Ramo, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 17/040,669

(22) PCT Filed: Mar. 25, 2019

(86) PCT No.: PCT/FI2019/050243
§ 371 (c)(1),
(2) Date: Sep. 23, 2020

(87) PCT Pub. No.: WO2019/185990
PCT Pub. Date: Oct. 3, 2019

(65) Prior Publication Data

US 2021/0051430 A1 Feb. 18, 2021

(30) Foreign Application Priority Data

Mar. 29, 2018 (GB) ..... 1805216

(51) Int. Cl.
*H04S 3/00* (2006.01)
*G10L 19/008* (2013.01)
*H04S 7/00* (2006.01)

(52) U.S. Cl.
CPC ..... *H04S 3/002* (2013.01); *G10L 19/008* (2013.01); *H04S 3/008* (2013.01); *H04S 7/30* (2013.01)

(58) Field of Classification Search
CPC ... G10L 19/008; H04S 3/008; H04S 2420/03; H04S 2400/13
(Continued)

(56) References Cited

U.S. PATENT DOCUMENTS 9,940,922 B1 * 4/2018 Schissler ..... G10K 15/08
2007/0127733 A1 6/2007 Henn et al. ..... 381/80
(Continued)

FOREIGN PATENT DOCUMENTS

CN 1957640 A 5/2007
CN 105898667 A 8/2016
(Continued)

OTHER PUBLICATIONS

Wilmering, Thomas, et al., "RDFx: Audio Effects Utilising Musical Metadata", 2010 IEEE fourth International Conference on Semantic Computing, pp. 452-453.
(Continued)

*Primary Examiner* — Alexander Krzystan
(74) *Attorney, Agent, or Firm* — Harrington & Smith

(57) ABSTRACT

An apparatus for spatial audio signal decoding including at least one processor and at least one memory including a computer program code configured to cause the apparatus at least to: receive at least one associated audio signal, the at least one associated audio signal based on a spatial audio signal; spatial metadata associated with the at least one associated audio signal, the spatial metadata including at least one parameter representing an ambiance energy distribution of the spatial audio signal and at least one directional parameter representing directional information of the spatial audio signal; synthesize from the at least one associated audio signal at least one output audio signal based on the at least one directional parameter and the least one parameter,
(Continued)

wherein the at least one parameter controls ambiance energy distribution of the at least one output signal.

20 Claims, 9 Drawing Sheets

(58) Field of Classification Search
USPC ..... 381/57, 22, 23
See application file for complete search history.

(56) References Cited

U.S. PATENT DOCUMENTS

| | | | | |
|---|---|---|---|---|
| 2008/0144864 | A1* | 6/2008 | Huon | H04R 3/005 381/305 |
| 2016/0345116 | A1 | 11/2016 | Yen et al. | 7/306 |
| 2017/0098452 | A1* | 4/2017 | Tracey | G10L 19/20 |
| 2017/0125030 | A1 | 5/2017 | Koppens et al. | |
| 2018/0084367 | A1 | 3/2018 | Greff et al. | |
| 2018/0262856 | A1* | 9/2018 | Wang | H04S 5/005 |

FOREIGN PATENT DOCUMENTS

| | | | |
|---|---|---|---|
| CN | 107017000 | A | 8/2017 |
| EP | 2 205 007 | A1 | 7/2010 |
| EP | 2 733 965 | A1 | 5/2014 |
| EP | 3 297 298 | A1 | 3/2018 |
| KR | 20160078142 | A | 7/2016 |
| TW | 2015236600 | A | 6/2015 |

OTHER PUBLICATIONS http://www.dif.net.cn; Digita ILibrary Forum, 2007, 8 pgs.

Pulkki Ville et al. "Parametric Spatial Audio Reproduction with Higher-Order B-Format Microphone Input" Convention Paper 8920, AES Convention 134; May 4-7, 2013.

Archontis Politis et al. "Acoustic Intensity, Energy-Density and Diffuseness Estimation in a Directionally-Constrained Region" Arxiv.org Cornell University Library Sep. 12, 2016.

* cited by examiner

SPATIAL SOUND RENDERING

CROSS REFERENCE TO RELATED APPLICATION

This patent application is a U.S. National Stage application of International Patent Application Number PCT/FI2019/050243 filed Mar. 25, 2019, which is hereby incorporated by reference in its entirety, and claims priority to GB 1805216.7 filed Mar. 29, 2018.

FIELD

The present application relates to apparatus and methods for spatial sound rendering. This includes but is not exclusively for spatial sound rendering for multichannel loudspeaker setups.

BACKGROUND

Parametric spatial audio processing is a field of audio signal processing where the spatial aspect of the sound is described using a set of parameters. For example, in parametric spatial audio capture from microphone arrays, it is a typical and an effective choice to estimate from the microphone array signals a set of parameters such as directions of the sound in frequency bands, and the ratio parameters expressing relative energies of the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

The directions and direct-to-total energy ratios in frequency bands are thus a parameterization that is particularly effective for spatial audio capture.

A parameter set consisting of a direction parameter in frequency bands and an energy ratio parameter in frequency bands (indicating the proportion of the sound energy that is directional) can be also utilized as the spatial metadata for an audio codec. For example, these parameters can be estimated from microphone-array captured audio signals, and for example a stereo signal can be generated from the microphone array signals to be conveyed with the spatial metadata. The stereo signal could be encoded, for example, with an AAC encoder. A decoder can decode the audio signals into PCM signals, and process the sound in frequency bands (using the spatial metadata) to obtain the spatial output, for example a binaural output.

The parametric encoder input formats may be one or several input formats. An example input format is a first-order Ambisonics (FOA) format. Analyzing FOA input for spatial metadata extraction is documented in scientific literature related to Directional Audio Coding (DirAC) and Harmonic planewave expansion (Harpex). This is because there exists specialist microphone arrays able to directly provide a FOA signal (or specifically a variant, the B-format signal), and analysing such an input has been implemented.

SUMMARY

There is provided according to an apparatus comprising at least one processor and at least one memory including a computer program code, the at least one memory and the computer program code configured to, with the at least one processor, cause the apparatus at least to: receive at least one associated audio signal, the at least one associated audio signal based on a spatial audio signal; spatial metadata associated with the at least one associated audio signal, the spatial metadata comprising at least one parameter representing an ambiance energy distribution of the spatial audio signal and at least one directional parameter representing directional information of the spatial audio signal; synthesize from the at least one associated audio signal at least one output audio signal based on the at least one directional parameter and the least one parameter, wherein the at least one parameter controls ambiance energy distribution of the at least one output signal.

The apparatus caused to synthesize from the at least one associated audio signal at least one output audio signal based on the at least one directional parameter and the least one parameter, wherein the at least one parameter controls ambiance energy distribution of the at least one output signal may be further caused to: divide the at least one associated audio signals into a direct part and diffuse part based on the spatial metadata; synthesize a direct audio signal based on the direct part of the at least one associated audio signal and the at least one directional parameter; determine a diffuse part gains based on the at least one parameter representing an ambiance energy distribution of the at least one spatial audio signal; synthesize a diffuse audio signal based on the diffuse part of the at least one associated audio signal and the diffuse part gains; and combine the direct audio signal and diffuse audio signal to generate the at least one output audio signal.

The apparatus caused to synthesize a diffuse audio signal based on the diffuse part of the at least one associated audio signal may be caused to decorrelate the at least one associated audio signal.

The apparatus caused to determine the diffuse part gains based on the at least one parameter representing an ambiance energy distribution of the at least one spatial audio signal may be caused to: determine directions where a set of prototype output signals are pointing to; for each of the set of prototype output signals, determine whether the direction of the prototype output signal is within a sector defined by at least one parameter representing an ambiance energy distribution of the at least one spatial audio signal; set gains associated with prototype output signals within the sector to be on average larger than the gains associated with prototype output signals outside the sector.

The apparatus caused to set gains associated with prototype output signals within the sector to be on average larger than the gains associated with prototype output signals outside the sector may be caused to: set gains associated with prototype output signals within the sector to 1; set gains associated with prototype output signals outside the sector to 0; and normalise the sum of squares of the gains to be unity.

The apparatus caused to receive spatial metadata comprising at least one parameter representing an ambiance energy distribution of the at least one spatial audio signal and at least one directional parameter representing directional information of the spatial audio signal may be caused to perform at least one of: analyse the at least one spatial audio signal to determine the at least one parameter representing an ambiance energy distribution of the at least one spatial audio signal; and receive the at least one parameter representing an ambiance energy distribution of the at least one spatial audio signal.

The at least one directional parameter representing directional information of the spatial audio signal may comprise at least one of: at least one direction parameter representing a direction of arrival; a diffuseness parameter associated with the at least one direction parameter; and an energy ratio parameter associated with the at least one direction parameter.

The at least one parameter representing an ambiance energy distribution of the at least one spatial audio signal may comprise at least one of: a first parameter comprising at least one azimuth angle and/or at least one elevation angle associated with the at least one spatial sector with a local largest average ambient energy; at least one further parameter based on the extent angle of the at least one spatial sector with the local largest average ambient energy.

The at least one parameter representing an ambiance energy distribution of the at least one spatial audio signal may be a parameter represented on a frequency band by frequency band basis.

According to a second aspect there is provided an apparatus for spatial audio signal processing, the apparatus comprising at least one processor and at least one memory including a computer program code, the at least one memory and the computer program code configured to, with the at least one processor, cause the apparatus at least to: receive at least one spatial audio signal; determine from the at least one spatial audio signal at least one associated audio signal; determine spatial metadata associated with the at least one associated audio signal, wherein the spatial metadata comprises at least one parameter representing an ambiance energy distribution of the at least one spatial audio signal, and at least one directional parameter representing directional information of the spatial audio signal; transmit and/or store: the associated audio signal, and the spatial metadata comprising the at least one parameter representing an ambiance energy distribution of the at least one spatial audio signal and at least one directional parameter representing directional information of the spatial audio signal.

The apparatus caused to determine the spatial metadata comprising the at least one parameter representing an ambiance energy distribution of the at least one spatial audio signal and at least one directional parameter representing directional information of the spatial audio signal may be further caused to: form directional pattern filtered signals based on the at least one spatial audio signal to several spatial directions defined by an azimuth angle and/or an elevation angle; determine a weighted temporal average of the ambient energy per spatial sector based on the directional pattern filtered signals; determine at least one spatial sector with a local largest average ambient energy and generate a first parameter comprising at least one azimuth angle and/or at least one elevation angle associated with the at least one spatial sector with the local largest average ambient energy; determine an extent angle of the local largest average ambient energy based on a comparison of the average ambient energy of neighbouring spatial sectors to the local largest average ambient energy and generate at least one further parameter based on the extent angle of the at least one spatial sector with the local largest average ambient energy.

The apparatus caused to form directional pattern filtered signals signals based on the at least one spatial audio signal to several spatial directions defined by an azimuth angle and/or an elevation angle may be caused to form virtual cardioid signals defined by the azimuth angle and/or the elevation angle.

The apparatus caused to determine spatial metadata associated with the at least one spatial audio signal, wherein the spatial metadata comprises at least one parameter representing an ambiance energy distribution of the at least one spatial audio signal and at least one directional parameter representing directional information of the spatial audio signal may be caused to determine spatial metadata on a frequency band by frequency band basis.

According to a third aspect there is provided a method for spatial audio signal decoding, the method comprising: receiving at least one associated audio signal, the at least one associated audio signal based on a spatial audio signal; spatial metadata associated with the at least one associated audio signal, the spatial metadata comprising at least one parameter representing an ambiance energy distribution of the spatial audio signal and at least one directional parameter representing directional information of the spatial audio signal; synthesizing from the at least one associated audio signal at least one output audio signal based on the at least one directional parameter and the least one parameter, wherein the at least one parameter controls ambiance energy distribution of the at least one output signal.

Synthesizing from the at least one associated audio signal at least one output audio signal based on the at least one directional parameter and the least one parameter, wherein the at least one parameter controls ambiance energy distribution of the at least one output signal may further comprise: dividing the at least one associated audio signals into a direct part and diffuse part based on the spatial metadata; synthesizing a direct audio signal based on the direct part of the at least one associated audio signal and the at least one directional parameter; determining a diffuse part gains based on the at least one parameter representing an ambiance energy distribution of the at least one spatial audio signal; synthesizing a diffuse audio signal based on the diffuse part of the at least one associated audio signal and the diffuse part gains; and combining the direct audio signal and diffuse audio signal to generate the at least one output audio signal.

Synthesizing a diffuse audio signal based on the diffuse part of the at least one associated audio signal may comprise decorrelating the at least one associated audio signal.

Determining the diffuse part gains based on the at least one parameter representing an ambiance energy distribution of the at least one spatial audio signal may comprise: determining directions where a set of prototype output signals are pointing to; for each of the set of prototype output signals, determining whether the direction of the prototype output signal is within a sector defined by at least one parameter representing an ambiance energy distribution of the at least one spatial audio signal; setting gains associated with prototype output signals within the sector to be on average larger than the gains associated with prototype output signals outside the sector.

Setting gains associated with prototype output signals within the sector to be on average larger than the gains associated with prototype output signals outside the sector may comprise: setting gains associated with prototype output signals within the sector to 1; setting gains associated with prototype output signals outside the sector to 0; and normalising the sum of squares of the gains to be unity.

Receiving spatial metadata comprising at least one parameter representing an ambiance energy distribution of the at least one spatial audio signal and at least one directional parameter representing directional information of the spatial audio signal may comprise at least one of: analysing the at least one spatial audio signal to determine the at least one parameter representing an ambiance energy distribution of the at least one spatial audio signal; and receiving the at least one parameter representing an ambiance energy distribution of the at least one spatial audio signal.

The at least one directional parameter representing directional information of the spatial audio signal may comprise at least one of: at least one direction parameter representing a direction of arrival; a diffuseness parameter associated with the at least one direction parameter; and an energy ratio parameter associated with the at least one direction parameter.

The at least one parameter representing an ambiance energy distribution of the at least one spatial audio signal may comprise at least one of: a first parameter comprising at least one azimuth angle and/or at least one elevation angle associated with the at least one spatial sector with a local largest average ambient energy; at least one further parameter based on the extent angle of the at least one spatial sector with the local largest average ambient energy.

The at least one parameter representing an ambiance energy distribution of the at least one spatial audio signal may be a parameter represented on a frequency band by frequency band basis.

According to a fourth aspect there is provided a method for spatial audio signal processing, the method comprising: receiving at least one spatial audio signal; determining from the at least one spatial audio signal at least one associated audio signal; determining spatial metadata associated with the at least one associated audio signal, wherein the spatial metadata comprises at least one parameter representing an ambiance energy distribution of the at least one spatial audio signal, and at least one directional parameter representing directional information of the spatial audio signal; transmitting and/or storing: the associated audio signal, and the spatial metadata comprising the at least one parameter representing an ambiance energy distribution of the at least one spatial audio signal and at least one directional parameter representing directional information of the spatial audio signal.

Determining the spatial metadata comprising the at least one parameter representing an ambiance energy distribution of the at least one spatial audio signal and at least one directional parameter representing directional information of the spatial audio signal may further comprise: forming directional pattern filtered signals based on the at least one spatial audio signal to several spatial directions defined by an azimuth angle and/or an elevation angle; determining a weighted temporal average of the ambient energy per spatial sector based on the directional pattern filtered signals; determining at least one spatial sector with a local largest average ambient energy and generate a first parameter comprising at least one azimuth angle and/or at least one elevation angle associated with the at least one spatial sector with the local largest average ambient energy; determining an extent angle of the local largest average ambient energy based on a comparison of the average ambient energy of neighbouring spatial sectors to the local largest average ambient energy and generate at least one further parameter based on the extent angle of the at least one spatial sector with the local largest average ambient energy.

Forming directional pattern filtered signals signals based on the at least one spatial audio signal to several spatial directions defined by an azimuth angle and/or an elevation angle may comprise forming virtual cardioid signals defined by the azimuth angle and/or the elevation angle.

Determining spatial metadata associated with the at least one spatial audio signal, wherein the spatial metadata comprises at least one parameter representing an ambiance energy distribution of the at least one spatial audio signal and at least one directional parameter representing directional information of the spatial audio signal may comprise determining spatial metadata on a frequency band by frequency band basis.

According to a fifth aspect there is provided an apparatus comprising means for: receiving at least one associated audio signal, the at least one associated audio signal based on a spatial audio signal; spatial metadata associated with the at least one associated audio signal, the spatial metadata comprising at least one parameter representing an ambiance energy distribution of the spatial audio signal and at least one directional parameter representing directional information of the spatial audio signal; synthesizing from the at least one associated audio signal at least one output audio signal based on the at least one directional parameter and the least one parameter, wherein the at least one parameter controls ambiance energy distribution of the at least one output signal.

The means for synthesizing from the at least one associated audio signal at least one output audio signal based on the at least one directional parameter and the least one parameter, wherein the at least one parameter controls ambiance energy distribution of the at least one output signal may further be configured for: dividing the at least one associated audio signals into a direct part and diffuse part based on the spatial metadata; synthesizing a direct audio signal based on the direct part of the at least one associated audio signal and the at least one directional parameter; determining a diffuse part gains based on the at least one parameter representing an ambiance energy distribution of the at least one spatial audio signal; synthesizing a diffuse audio signal based on the diffuse part of the at least one associated audio signal and the diffuse part gains; and combining the direct audio signal and diffuse audio signal to generate the at least one output audio signal.

The means for synthesizing a diffuse audio signal based on the diffuse part of the at least one associated audio signal may be configured for decorrelating the at least one associated audio signal.

The means for determining the diffuse part gains based on the at least one parameter representing an ambiance energy distribution of the at least one spatial audio signal may be configured for: determining directions where a set of prototype output signals are pointing to; for each of the set of prototype output signals, determining whether the direction of the prototype output signal is within a sector defined by at least one parameter representing an ambiance energy distribution of the at least one spatial audio signal; setting gains associated with prototype output signals within the sector to be on average larger than the gains associated with prototype output signals outside the sector.

The means for setting gains associated with prototype output signals within the sector to be on average larger than the gains associated with prototype output signals outside the sector may be configured for: setting gains associated with prototype output signals within the sector to 1; setting gains associated with prototype output signals outside the sector to 0; and normalising the sum of squares of the gains to be unity.

The means for receiving spatial metadata comprising at least one parameter representing an ambiance energy distribution of the at least one spatial audio signal and at least one directional parameter representing directional information of the spatial audio signal may be configured for at least one of: analysing the at least one spatial audio signal to determine the at least one parameter representing an ambiance energy distribution of the at least one spatial audio signal;

and receiving the at least one parameter representing an ambiance energy distribution of the at least one spatial audio signal.

The at least one directional parameter representing directional information of the spatial audio signal may comprise at least one of: at least one direction parameter representing a direction of arrival; a diffuseness parameter associated with the at least one direction parameter; and an energy ratio parameter associated with the at least one direction parameter.

The at least one parameter representing an ambiance energy distribution of the at least one spatial audio signal may comprise at least one of: a first parameter comprising at least one azimuth angle and/or at least one elevation angle associated with the at least one spatial sector with a local largest average ambient energy; at least one further parameter based on the extent angle of the at least one spatial sector with the local largest average ambient energy.

The at least one parameter representing an ambiance energy distribution of the at least one spatial audio signal may be a parameter represented on a frequency band by frequency band basis.

According to a sixth aspect there is provided an apparatus for spatial audio signal processing, the apparatus comprising means for: receiving at least one spatial audio signal; determining from the at least one spatial audio signal at least one associated audio signal; determining spatial metadata associated with the at least one associated audio signal, wherein the spatial metadata comprises at least one parameter representing an ambiance energy distribution of the at least one spatial audio signal, and at least one directional parameter representing directional information of the spatial audio signal; transmitting and/or storing: the associated audio signal, and the spatial metadata comprising the at least one parameter representing an ambiance energy distribution of the at least one spatial audio signal and at least one directional parameter representing directional information of the spatial audio signal.

The means for determining the spatial metadata comprising the at least one parameter representing an ambiance energy distribution of the at least one spatial audio signal and at least one directional parameter representing directional information of the spatial audio signal may further be configured for: forming directional pattern filtered signals based on the at least one spatial audio signal to several spatial directions defined by an azimuth angle and/or an elevation angle; determining a weighted temporal average of the ambient energy per spatial sector based on the directional pattern filtered signals; determining at least one spatial sector with a local largest average ambient energy and generate a first parameter comprising at least one azimuth angle and/or at least one elevation angle associated with the at least one spatial sector with the local largest average ambient energy; determining an extent angle of the local largest average ambient energy based on a comparison of the average ambient energy of neighbouring spatial sectors to the local largest average ambient energy and generate at least one further parameter based on the extent angle of the at least one spatial sector with the local largest average ambient energy.

The means for forming directional pattern filtered signals signals based on the at least one spatial audio signal to several spatial directions defined by an azimuth angle and/or an elevation angle may be configured for forming virtual cardioid signals defined by the azimuth angle and/or the elevation angle.

The means for determining spatial metadata associated with the at least one spatial audio signal, wherein the spatial metadata comprises at least one parameter representing an ambiance energy distribution of the at least one spatial audio signal and at least one directional parameter representing directional information of the spatial audio signal may be configured for determining spatial metadata on a frequency band by frequency band basis. According to a seventh aspect there is provided an apparatus comprising: receiving circuitry configured to receive at least one associated audio signal, the at least one associated audio signal based on a spatial audio signal; spatial metadata associated with the at least one associated audio signal, the spatial metadata comprising at least one parameter representing an ambiance energy distribution of the spatial audio signal and at least one directional parameter representing directional information of the spatial audio signal; synthesizing circuitry configured to synthesize from the at least one associated audio signal at least one output audio signal based on the at least one directional parameter and the least one parameter, wherein the at least one parameter controls ambiance energy distribution of the at least one output signal.

According to an eighth aspect there is provided an apparatus for spatial audio signal processing, the apparatus comprising: receiving circuitry configured to receive at least one spatial audio signal; determining circuitry configured to determine from the at least one spatial audio signal at least one associated audio signal; determining circuitry configured to determine spatial metadata associated with the at least one associated audio signal, wherein the spatial metadata comprises at least one parameter representing an ambiance energy distribution of the at least one spatial audio signal, and at least one directional parameter representing directional information of the spatial audio signal; transmitting and/or storing circuitry configured to transmit and/or store: the associated audio signal, and the spatial metadata comprising the at least one parameter representing an ambiance energy distribution of the at least one spatial audio signal and at least one directional parameter representing directional information of the spatial audio signal.

According to a ninth aspect there is provided a computer program comprising instructions [or a computer readable medium comprising program instructions] for causing an apparatus to perform at least the following: receiving at least one associated audio signal, the at least one associated audio signal based on a spatial audio signal; spatial metadata associated with the at least one associated audio signal, the spatial metadata comprising at least one parameter representing an ambiance energy distribution of the spatial audio signal and at least one directional parameter representing directional information of the spatial audio signal; synthesizing from the at least one associated audio signal at least one output audio signal based on the at least one directional parameter and the least one parameter, wherein the at least one parameter controls ambiance energy distribution of the at least one output signal.

According to an tenth aspect there is provided computer program comprising instructions [or a computer readable medium comprising program instructions] for causing an apparatus to perform at least the following: receiving at least one spatial audio signal; determining from the at least one spatial audio signal at least one associated audio signal; determining spatial metadata associated with the at least one associated audio signal, wherein the spatial metadata comprises at least one parameter representing an ambiance energy distribution of the at least one spatial audio signal, and at least one directional parameter representing directional information of the spatial audio signal; transmitting and/or storing circuitry configured to transmit and/or store: the associated audio signal, and the spatial metadata comprising the at least one parameter representing an ambiance energy distribution of the at least one spatial audio signal and at least one directional parameter representing directional information of the spatial audio signal.

According to an eleventh aspect there is provided a non-transitory computer readable medium comprising program instructions for causing an apparatus to perform at least the following: receiving at least one associated audio signal, the at least one associated audio signal based on a spatial audio signal; spatial metadata associated with the at least one associated audio signal, the spatial metadata comprising at least one parameter representing an ambiance energy distribution of the spatial audio signal and at least one directional parameter representing directional information of the spatial audio signal; synthesizing from the at least one associated audio signal at least one output audio signal based on the at least one directional parameter and the least one parameter, wherein the at least one parameter controls ambiance energy distribution of the at least one output signal.

According to a twelfth aspect there is provided a non-transitory computer readable medium comprising program instructions for causing an apparatus to perform at least the following: receiving at least one spatial audio signal; determining from the at least one spatial audio signal at least one associated audio signal; determining spatial metadata associated with the at least one associated audio signal, wherein the spatial metadata comprises at least one parameter representing an ambiance energy distribution of the at least one spatial audio signal, and at least one directional parameter representing directional information of the spatial audio signal; transmitting and/or storing circuitry configured to transmit and/or store: the associated audio signal, and the spatial metadata comprising the at least one parameter representing an ambiance energy distribution of the at least one spatial audio signal and at least one directional parameter representing directional information of the spatial audio signal.

According to an thirteenth aspect there is provided a computer readable medium comprising program instructions for causing an apparatus to perform at least the following: receiving at least one associated audio signal, the at least one associated audio signal based on a spatial audio signal; spatial metadata associated with the at least one associated audio signal, the spatial metadata comprising at least one parameter representing an ambiance energy distribution of the spatial audio signal and at least one directional parameter representing directional information of the spatial audio signal; synthesizing from the at least one associated audio signal at least one output audio signal based on the at least one directional parameter and the least one parameter, wherein the at least one parameter controls ambiance energy distribution of the at least one output signal.

According to a fourteenth aspect there is provided a computer readable medium comprising program instructions for causing an apparatus to perform at least the following: receiving at least one spatial audio signal; determining from the at least one spatial audio signal at least one associated audio signal; determining spatial metadata associated with the at least one associated audio signal, wherein the spatial metadata comprises at least one parameter representing an ambiance energy distribution of the at least one spatial audio signal, and at least one directional parameter representing directional information of the spatial audio signal; transmitting and/or storing circuitry configured to transmit and/or store: the associated audio signal, and the spatial metadata comprising the at least one parameter representing an ambiance energy distribution of the at least one spatial audio signal and at least one directional parameter representing directional information of the spatial audio signal.

A non-transitory computer readable medium comprising program instructions for causing an apparatus to perform the method as described above. An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
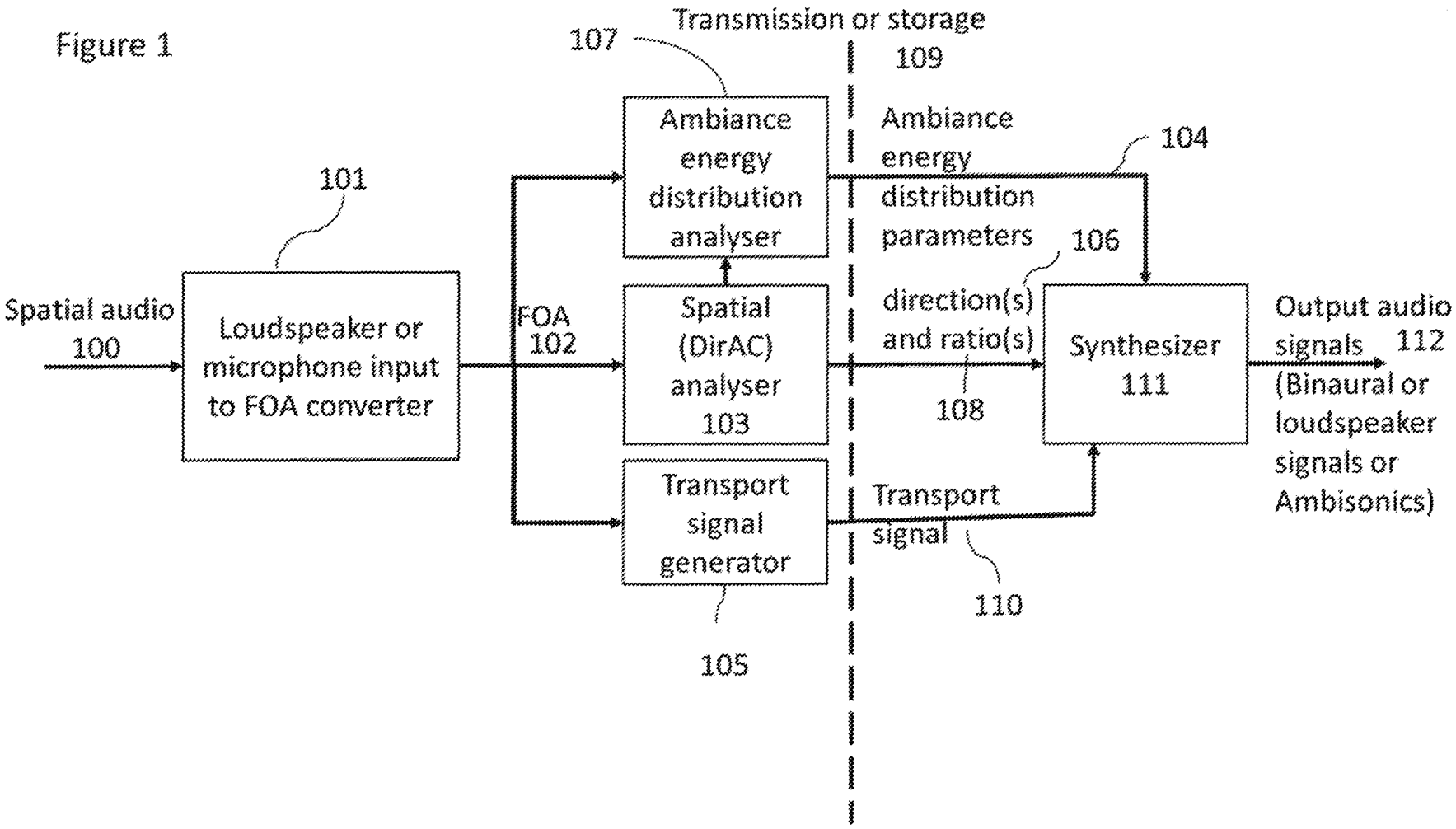
FIG. 1 shows schematically an example spatial capture and synthesizer according to some embodiments.

The following describes in further detail suitable apparatus and possible mechanisms for the provision of efficient spatial processing and rendering based on a range of audio input formats.

Spatial metadata consisting of directions and direct-to-total energy ratio (or diffuseness-ratio) parameters in frequency bands is particularly suitable for expressing the perceptual properties of natural sound fields.

However, sound scenes can be of various kinds and there are situations where the sound field has a non-uniform distribution of ambient energy (e.g., ambiance only or mostly at certain axis or spatial area). The concept as discussed in the embodiments herein describe apparatus and methods for accurately reproducing the spatial distribution of the diffuse/ambient sound energy at the reproduced sound when compared to the original spatial sound.

In some embodiments this may be selectable and therefore the effect may be controlled, during rendering, to determine whether the intent is to reproduce a uniform distribution of ambient energy or whether the intent is to reproduce the distribution of ambient energy of the original sound scene. Reproducing a uniform distribution of ambient energy can in different embodiments refer either to a uniform distribution of ambient energy to different output channels or a distribution of ambient energy in a spatially balanced way.

The concept as discussed in further detail hereafter is to add an ambient energy distribution metadata field or parameter in the bitstream and utilize this field or parameter during rendering to enable reproducing the spatial audio such that it more closely represents the original sound field.

As such the embodiments described hereafter relate to audio encoding and decoding using a sound-field related parameterization (direction(s) and ratio(s) in frequency bands) and where these embodiments aim to improve the reproduction quality of sound fields encoded with the aforementioned parameterization. Furthermore these embodiments describe where the reproduction quality is improved by conveying ambiance energy distribution parameters along with the directional parameter(s), and reproducing the sound based on the directional parameter(s) and ambiance energy distribution parameters, such that the ambiance energy distribution parameter affects the diffuse stream synthesis using the direction(s) and ratio(s) in frequency bands.

In particular, the embodiments as discussed hereafter are configured to modify the diffuse stream synthesis using the ambiance energy distribution parameters such that the energy distribution of sound field is better reproduced.

In some embodiments the ambiance energy distribution parameters comprise at least a direction and an extent or width associated with the analysed ambiance energy distribution.

In some embodiments the input/processing may be implemented for First order Ambisonics (FOA) inputs and for higher order Ambisonics (HOA) inputs. In embodiments using HOA inputs instead of forming virtual cardioid signals as described hereafter with respect to FOA inputs the method can substitute the virtual cardioid signals c(k, n) with signals with one-sided directional patterns (or predominantly one-sided directional patterns) formed from zeroth to second or higher order HOA components, or any suitable means to generate signals with one-sided directional patterns from the HOA signals.

With respect to FIG. 1 an example spatial capture and synthesizer according to some embodiments is shown. The spatial capture and synthesizer is shown in this example receiving a spatial audio signal 100 as an input. The spatial audio signal 100 may be any suitable audio signal format, for example microphone audio signals captured by microphones or a microphone comprising a microphone array, a synthetic audio signal, a loudspeaker channel format audio signal, or a first-order Ambisonics (FOA) format or a variant thereof (such as B-format signals) or higher-order Ambisonics (HOA).

In some embodiments a converter (for example a loudspeaker or microphone input to FOA converter) 101 is configured to receive the input audio signal 101 and convert it to a suitable FOA format signal 102.

The converter 101 in some embodiments is configured to generate the FOA signals from a loudspeaker mix based on knowledge of the positions of the channels in the input audio signals. In other words the $w_i(t)$, $x_i(t)$, $y_i(t)$, $z_i(t)$ components of a FOA signal can be generated from a loudspeaker signal $s_i(t)$ at $azi_i$ and $ele_i$ by $$FOA_i(T) = \begin{bmatrix} w_i(t) \\ x_i(t) \\ y_i(t) \\ z_i(t) \end{bmatrix} = s_i(t) \begin{bmatrix} 1 \\ \cos(azi_i)\cos(ele_i) \\ \sin(azi_i)\cos(ele_i) \\ \sin(ele_i) \end{bmatrix}$$

The w,x,y,z signals are generated for each loudspeaker (or object) signal $s_i$ having its own azimuth and elevation direction.

The output signal combining all such signals may be calculated as $\Sigma_{i=1}^{NUM_CH} FOA_i(t)$. In other words the combination of each speaker or channel signal to the total FOA signals.

The converter 101 in some embodiments is configured to generate the FOA signals from a microphone array signal according to any suitable method. The converter may use a linear approach to obtain a FOA signal from a microphone signal, in other words, to apply a matrix of filters or a matrix of complex gains in frequency bands to obtain FOA signal from a microphone array signal. The converter may be configured to extract features from the audio signals, and the signals processed differently depending on these features. The embodiments described herein describe the adaptive processing in terms of at least at some frequency bands and/or spherical harmonic orders, and/or spatial dimensions. Thus in contrast to conventional ambisonics there is no linear correspondence between output and input. In some embodiments the output of the converter is in the time-frequency domain. In other words the converter 101 is in some embodiments configured to apply a suitable time-frequency transform. In some embodiments the input spatial audio 100 is in the time-frequency domain or may be passed through a suitable transform or filter bank.

In some embodiments the converter uses a matrix of designed linear filters to the microphone signals to obtain the spherical harmonic components. An equivalent alternative approach is to transform the microphone signals to the time-frequency domain, and for each frequency band use a designed mixing matrix to obtain the spherical harmonic signals in the time-frequency domain. A further conversion method is one wherein spatial audio capture (SPAC) techniques which represent methods for spatial audio capture from microphone arrays and output an ambisonic format based on the dynamic SPAC analysis. Spatial audio capture (SPAC) refers here to techniques that use adaptive time-frequency analysis and processing to provide high perceptual quality spatial audio reproduction from any device equipped with a microphone array. At least 3 microphones are required for SPAC capture in horizontal plane, and at least 4 microphones are required for 3D capture. The SPAC methods are adaptive, in other words they use non-linear approaches to improve on spatial accuracy from the state-of-the art traditional linear capture techniques.

The term SPAC is used in this document as a generalized term covering any adaptive array signal processing technique providing spatial audio capture. The methods in scope apply the analysis and processing in frequency band signals, since it is a domain that is meaningful for spatial auditory perception. Spatial metadata such as directions of the arriving sounds, and/or ratio or energy parameters determining the directionality or non-directionality of the recorded sound, are dynamically analysed in frequency bands. The metadata is applied at the reproduction stage to dynamically synthesize spatial sound to headphones or loudspeakers or to Ambisonic (e.g. FOA) output with a high spatial accuracy. For example, a plane wave arriving to the array can be reproduced as a point source at the receiver end.

One method of spatial audio capture (SPAC) reproduction is Directional Audio Coding (DirAC), which is a method using sound field intensity and energy analysis to provide spatial metadata that enables the high-quality adaptive spatial audio synthesis for loudspeakers or headphones. Another example is harmonic planewave expansion (Harpex), which is a method that can analyse two plane waves simultaneously, which may further improve the spatial precision in certain sound field conditions. A further method is a method intended primarily for mobile phone spatial audio capture, which uses delay and coherence analysis between the microphones to obtain the spatial metadata, and its variant for devices containing more microphones. Although two variants are described in the following examples, any suitable method applied to obtain the spatial metadata can be used.

A spatial analyser 103 may be configured to receive the FOA signals 102 and generate suitable spatial parameters such as directions 106 and ratios 108. The spatial analyser 103 can, for example, be a computer or a mobile phone (running suitable software), or alternatively a specific device utilizing, for example, field programmable gate arrays (FPGAs) or application specific integrated circuits (ASICs). In some embodiments where the converter 101 employs spatial audio capture techniques to convert the input audio signal format to a FOA format signal then the spatial analyser 103 may comprise the converter 101 or the converter may comprise the spatial analyser 103.

A suitable spatial analysis method example is Directional Audio Coding (DirAC). DirAC methods may estimate the directions and diffuseness ratios (equivalent information to a direct-to-total ratio parameter) from a first-order Ambisonic (FOA) signal.

In some embodiments the DirAC method transforms the FOA signals into frequency bands using a suitable time to frequency domain transform, for example using a short time Fourier transform (STFT), resulting in time-frequency signals w(k,n), x(k,n), y(k,n), z(k,n) where k is the frequency bin index and n is the time index. In such examples the DirAC method may estimate the intensity vector by $$I(k,n) = -\mathrm{Re}\left\{ w^*(k,n) \begin{bmatrix} x(k,n) \\ y(k,n) \\ z(k,n) \end{bmatrix} \right\}$$

where Re means real-part, and asterisk * means complex conjugate. The intensity expresses the direction of the propagating sound energy, and thus the direction parameter may be determined by the opposite direction of the intensity vector.

The intensity vector in some embodiments may be averaged over several time and/or frequency indices prior to the determination of the direction parameter.

Furthermore in some embodiments the DirAC method may determine the diffuseness based on FOA components (assuming Schmidt semi-normalisation (SN3D normalization)). In SN3D normalisation for diffuse sound the sum of energies of all Ambisonic components within an order is equal. E.g., if zeroth order W has 1 unit of energy, then each first order X Y Z have ⅓ units of energy (sum is 1). And so forth for higher orders.

The diffuseness may therefore be determined as $$\psi(k,n) = 1 - \frac{|E[I(k,n)]|}{E[0.5(w^2(k,n) + x^2(k,n) + y^2(k,n) + z^2(k,n))]}$$

The diffuseness is a ratio value that is 1 when the sound is fully ambient, and 0 when the sound is fully directional. In some embodiments all parameters in the equation are typically averaged over time and/or frequency. The expectation operator E[ ] can be replaced with an average operator in some systems.

In some embodiments, the direction parameter and the diffuseness parameter may be analysed from FOA components which have been obtained in two different ways. In particular, in this embodiment the direction parameter may be analysed from the signals $\Sigma_{i=1}^{NUM_CH}$ $FOA_i(t)$ as described above. The diffuseness may be analysed from another set of FOA signals denoted as $\Sigma_{i=1}^{NUM_CH}$ $\widehat{FOA}_i$ (t), and described in more detail below. As a particular example, let us consider the conversion to FOA components from a 5.0 input having loudspeakers at azimuth angles 0, +/−30, and +/−110 (all elevations are zero, $\cos(ele_i)=1$, $\sin(ele_i)=0$ for all i). The FOA components for the analysis of the direction parameter are obtained as above:

$$FOA_i(t) = \begin{bmatrix} w_i(t) \\ x_i(t) \\ y_i(t) \\ z_i(t) \end{bmatrix} = s_i(t) \begin{bmatrix} 1 \\ \cos(azi_i) \\ \sin(azi_i) \\ 0 \end{bmatrix}$$

The diffuseness may be analysed from another set of FOA signals obtained as $$\widehat{FOA}_i(t) = \begin{bmatrix} \hat{w}_i(t) \\ \hat{x}_i(t) \\ \hat{y}_i(t) \\ \hat{z}_i(t) \end{bmatrix} = s_i(t) \begin{bmatrix} 1 \\ \cos(\widehat{azi}_i) \\ \sin(\widehat{azi}_i) \\ 0 \end{bmatrix}$$

where $\widehat{azi}_i$ is a modified virtual loudspeaker position. The modified virtual loudspeaker positions for diffuseness analysis are obtained such that the virtual loudspeakers locate with even spacing when creating the FOA signals. The benefit of such evenly-spaced positioning of the virtual loudspeakers for diffuseness analysis is that the incoherent sound is arriving evenly from different directions around the virtual microphone and the temporal average of the intensity vector sums up to values near zero. In the case of 5.0, the modified virtual loudspeaker positions are 0, +/−72, +/−144 degrees. Thus, the virtual loudspeakers have a constant 72 degree spacing.

Similar modified virtual loudspeaker positions can be created for other loudspeaker configurations to ensure a constant spacing between adjacent speakers. In an embodiment of the invention, the modified virtual loudspeaker spacing is obtained by dividing the full 360 degrees with the number of loudspeakers in the horizontal plane. The modified virtual loudspeaker positions are then obtained by positioning the virtual loudspeakers with the obtained spacing starting from the centre speaker or other suitable starting speaker.

In some embodiments an alternative ratio parameter may be determined, for example, a direct-to-total energy ratio, which can be obtained as $$r(k,n)=1-\psi(k,n)$$

When averaged, the diffuseness (and direction) parameters may be determined in frequency bands combining several frequency bins k, for example, approximating the Bark frequency resolution.

DirAC, as described above, is one possible spatial analysis method option to determine the directional and ratio metadata. The spatial audio parameters also called spatial metadata or metadata may be determined according to any suitable method. For example by simulating a microphone array and using a spatial audio capture (SPAC) algorithm. Furthermore the spatial metadata may include (but are not limited to): Direction and direct-to-total energy ratio; Direction and diffuseness; Inter-channel level difference, inter-channel phase difference, and inter-channel coherence. In some embodiments these parameters are determined in time-frequency domain. It should be noted that also other parametrizations may be used than those presented above. In general, typically the spatial audio parametrizations describe how the sound is distributed in space, either generally (e.g., using directions) or relatively (e.g., as level differences between certain channels).

A transport signal generator 105 is further configured to receive the FOA signals 102 and generate suitable transport audio signals 110. The transport audio signals may also be known as associated audio signals and be based on the spatial audio signals which contains directional information of a sound field and which is input to the system. It is to be understood that a sound field in this context may refer either to a captured natural sound field with directional information or a surround sound scene with directional information created with known mixing and audio processing means. The transport signal generator 105 may be configured to generate any suitable number of transport audio signals (or channels), for example in some embodiments the transport signal generator is configured to generate two transport audio signals. In some embodiments the transport signal generator 105 is further configured to encode the audio signals. For example in some embodiments the audio signals may be encoded using an advanced audio coding (AAC) or enhanced voice services (EVS) compression coding. In some embodiments the transport signal generator 105 may be configured to equalize the audio signals, apply automatic noise control, dynamic processing, or any other suitable processing. In some embodiments the transport signal generator 105 can take the output of the Spatial analyser 103 as an input to facilitate the generation of the transport signal 110. In some embodiments the transport signal generator 105 can take the spatial audio signal 100 to generate the transport signals in place of the FOA signal 102.

The ambiance energy distribution analyser 107 may furthermore be configured to receive the output of the spatial analyser 103 and the FOA signals 102 and generate ambiance energy distribution parameters 104.

The ambiance energy distribution parameters 104, spatial metadata (the directions 106 and ratios 108) and the transport audio signals 110 may be transmitted or stored for example within some storage 107 such as memory, or alternatively directly processed in the same device. In some embodiments the ambiance energy distribution parameters 104, spatial metadata 106, 108 and the transport audio signals 110 may be encoded or quantized or combined or multiplexed into a single data stream by a suitable encoding and/or multiplexing operation. In some embodiments the coded audio signal is bundled with a video stream (e.g., 360-degree video) in a media container such as an mp4 container, to be transmitted to a suitable receiver.

The synthesizer 111 is configured to receive the ambiance energy distribution parameters 104, transport audio signals 110, the spatial parameters such as the directions 106 and the ratios 108 and generate the loudspeaker audio signals 112.

The synthesizer 111, for example may be configured to generate loudspeaker audio signals by employing spatial sound reproduction where sound in 3D space is positioned to arbitrary directions. The synthesizer 111 can, for example, be a computer or a mobile phone (running suitable software), or alternatively a specific device utilizing, for example, FPGAs or ASICs. Based on the data stream (the transport audio signals and the metadata). The synthesizer 111 can be configured to produce output audio signals. For headphone listening, the output signals can be binaural signals. In some other scenarios the output signals can be ambisonic signals, or signals in some other desired output format In some embodiments the spatial analyser and synthesizer (and other components as described herein may be implemented within the same device, and may be also a part of the same software.

Figure 2:
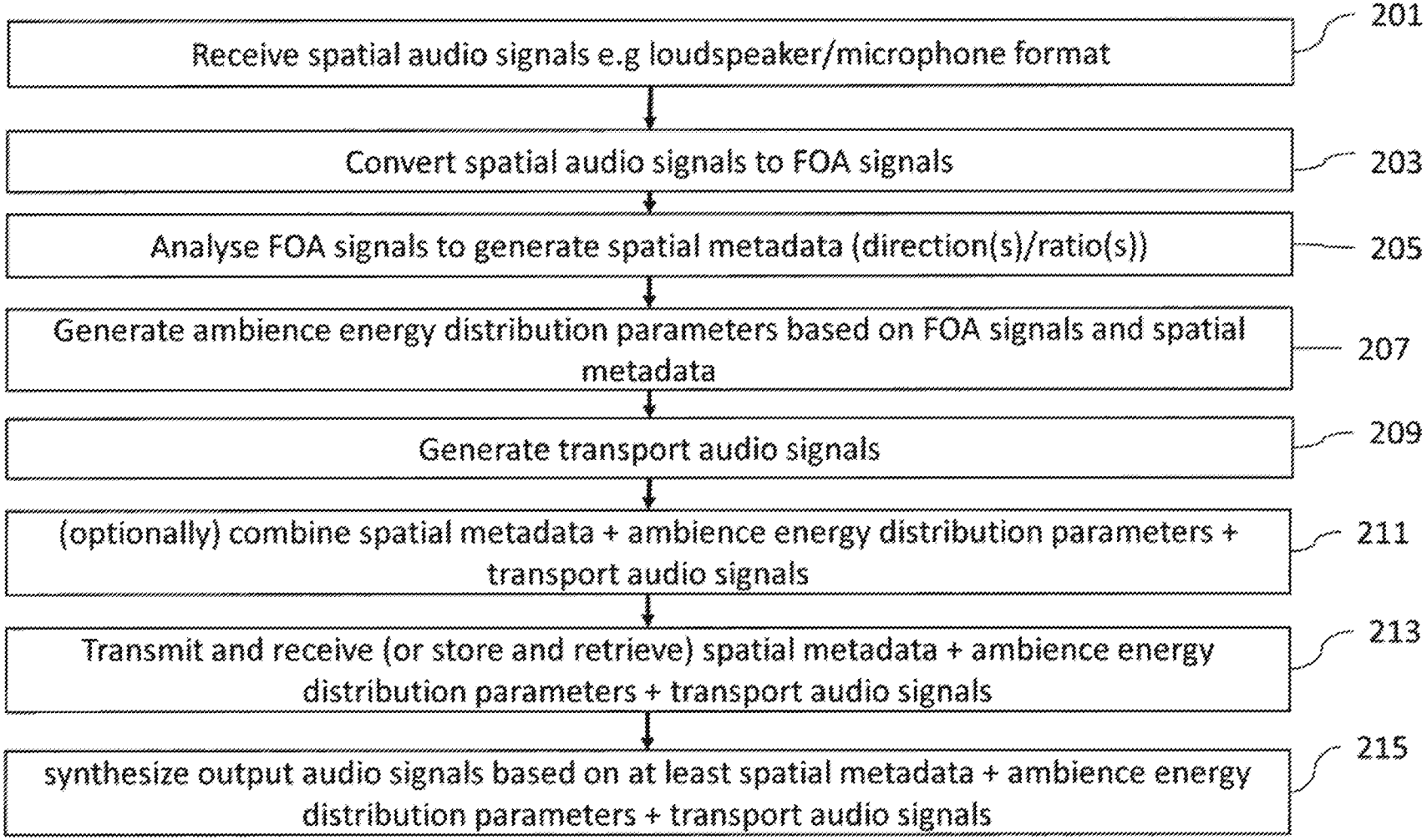
FIG. 2 shows a flow diagram of the method of operating the example spatial capture and synthesizer according to some embodiments.

With respect to FIG. 2 is shown an example summary of the operations of the apparatus shown in FIG. 1.

The initial operation is receiving the spatial audio signals (for example loudspeaker—5.0 format, microphone format) audio signals as shown in FIG. 2 by step 201.

The received loudspeaker format audio signals may be converted to a FOA signal or stream as shown in FIG. 2 by step 203.

The converted FOA signals may be analysed to generate the spatial metadata (for example the directions and/or energy ratios) as shown in FIG. 2 by step 205.

The ambiance energy distribution parameters may be determined from the converted FOA signals and an output from the spatial analyser is shown in FIG. 2 by step 207.

The converted FOA signals may also be processed to generate transport audio signals as shown in FIG. 2 by step 209.

The ambiance energy distribution parameters, transport audio signals and metadata may then be optionally combined to form a data stream as shown in FIG. 2 by step 211.

The ambiance energy distribution parameters, transport audio signals and metadata (or the combined data stream) may then be transmitted and received (or stored and retrieved) as shown in FIG. 2 by step 213.

Having received or retrieved the ambiance energy distribution parameters, transport audio signals and metadata (or data stream), the output audio signals may be synthesized based at least on the ambiance energy distribution parameters, transport audio signals and metadata as shown in FIG. 2 by step 215.

The synthesized audio signal output signals may then be output to a suitable output.

Figure 3:
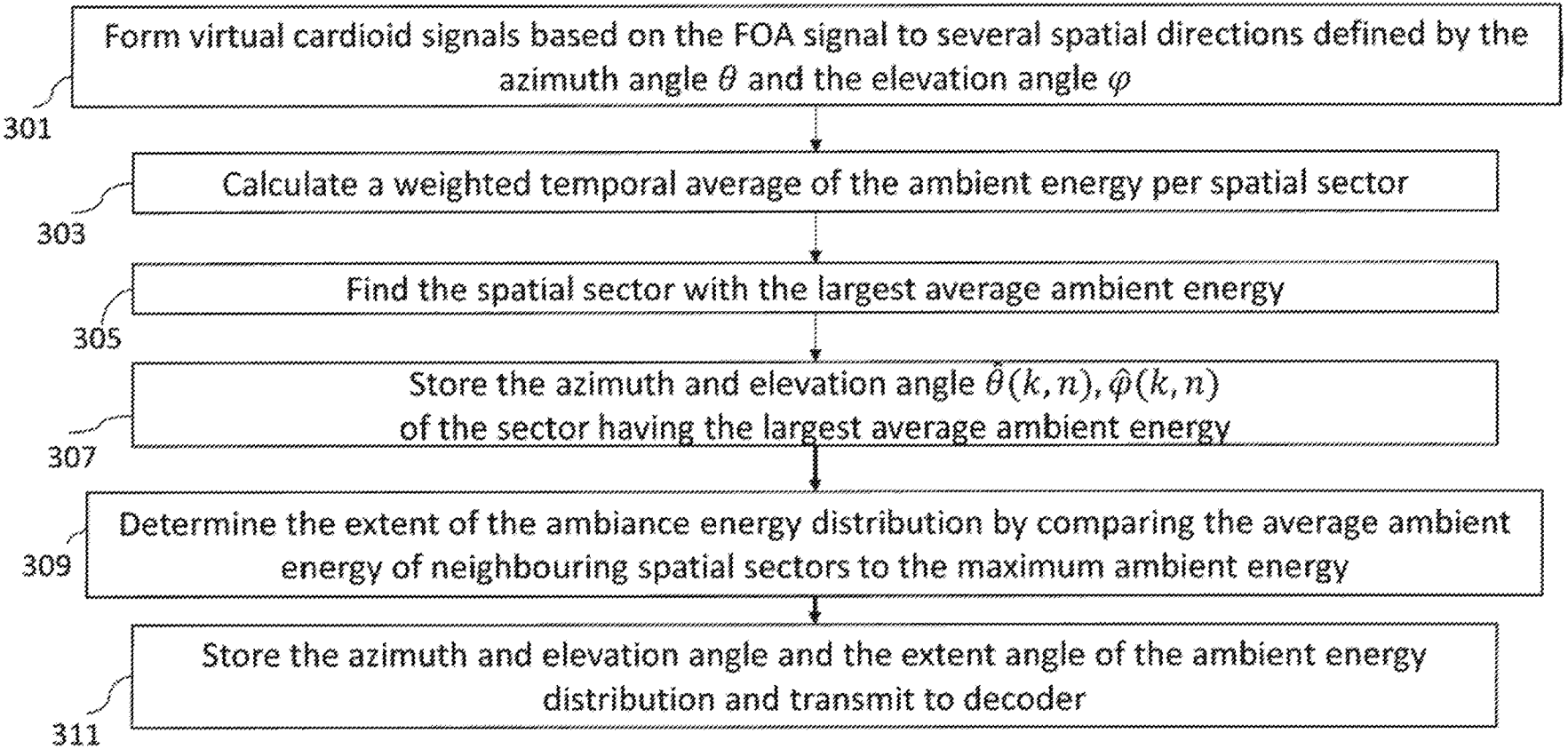
FIG. 3 shows a flow diagram of an example method of determining operating the example spatial synthesizer according to some embodiments.

With respect to FIG. 3 the operations of the ambiance energy distribution analyser 107 is shown in further detail.

The analysis for the ambient energy distribution is based on analysing the ambient energy at spatial sectors as a function of time (in frequency bands), finding the direction of at least the maximum of the ambient energy, and parameterizing the ambient energy distribution at least based on the direction of the maximum ambient energy.

In some embodiments the spatial sectors for the analysis of ambient energy can be obtained by forming virtual cardioid signals of the FOA signals to the desired spatial directions. A spatial direction is defined by the azimuth angle θ and the elevation angle φ.

The ambient energy distribution analyser may therefore obtain several of such spatial directions using this method. The spatial directions can be obtained, for example, as uniformly distributed azimuth angles, with an interval of 45 degrees.

In some embodiments the ambient energy distribution analyser may furthermore convert from a virtual cardioid signal c(k, n) to a spatial direction defined by the azimuth angle θ and the elevation angle φ by first obtaining a dipole signal d(k, n). This may for example be generated by:

$$d(k,n,\theta,\varphi)=\cos(\theta)\cos(\varphi)x(k,n)+\sin(\theta)\cos(\varphi)y(k,n)+\sin(\varphi)z(k,n)$$

where w(k,n), x(k,n), y(k,n), z(k,n) are the FOA time-frequency signals with k the frequency bin index and n is the time index. w(k,n) is the omnidirectional signal and x(k,n), y(k,n), z(k,n) are the dipoles corresponding to Cartesian coordinate axes. The cardioid signal is then obtained as $$c(k,n,\theta,\varphi)=0.5*d(k,n,\theta,\varphi)+0.5*w(k,n).$$

Although the example describes the use of cardioid patterns any suitable pattern may be employed. The method then calculates the ambient energy at the spatial direction corresponding to the cardioid signal c(k, n, θ, φ) as $$e(k,n,\theta,\varphi)=(1-r(k,n))*\frac{1}{N}|c(k,n,\theta,\varphi)|^2$$

where N is the length of the Discrete Fourier Transform used for converting the signals to the frequency domain, and r(k, n) is the direct-to-total energy ratio.

The generation of the virtual cardioid signals based on the FOA signals is shown in FIG. 3 by step 301.

The ambient energy distribution analyser may then be configured to calculate a weighted temporal average of the ambient energy per spatial sector. This for example may be obtained as:

$$\hat{e}(k,n,\theta,\varphi)=\alpha*e(k,n,\theta,\varphi)+(1-\alpha)*\hat{e}(k,n-1,\theta,\varphi)$$

with α=0.1.

The generation of the weighted temporal average of the ambient energy per spatial sector is shown in FIG. 3 by step 303.

The ambient energy distribution analyser may then be configured to determine the spatial sector with the largest average ambient energy. This may be determined as:

$$\hat{\theta}(k,n),\hat{\varphi}(k,n)=\mathrm{argmax}_{\theta,\varphi}\hat{e}(k,n,\theta,\varphi)$$

where $\hat{\theta}$(k, n), $\hat{\varphi}$(k, n) are the values of the azimuth and elevation θ, φ that maximize ê(k, n, θ, φ) at time n and frequency bin k.

The determination of the sector with the largest average ambient energy is shown in FIG. 3 by step 305.

The ambient energy distribution analyser may then employ the determined values $\hat{\theta}$(k, n), $\hat{\varphi}$(k, n) as the 'centre' of the ambiance energy distribution. In some embodiments the ambient energy distribution analyser may also store the maximum ambiance energy value.

$$\delta(k,n)=\max_{\theta,\varphi}\hat{e}(k,n,\theta,\varphi)$$

The operation of storing the azimuth and elevation angles of the sector having the largest average ambient energy is shown in FIG. 3 by step 307.

The ambient energy distribution analyser may then determine an extent (or width or spread) for the ambiance energy distribution. This can be done by inspecting the average ambient energy values ê(k, n, θ, φ) at other spatial directions θ=ρ, φ=σ such that ρ≠$\hat{\theta}$(k, n), σ≠$\hat{\varphi}$(k, n) and so that $\hat{\theta}$(k, n), $\hat{\varphi}$(k, n) is the neighboring spatial sector of ρ, σ. If the ambiance for this neighbouring spatial sector is larger than a threshold times the maximum value, extend the ambiance spatial extent over that spatial sector. That is, if the condition $$\hat{e}(k,n,\rho,\sigma)>\mathrm{thr}*\delta(k,n)$$

is fulfilled.

A suitable value for the threshold thr=0.9. If the above holds for the spatial sector ρ, σ then the ambiance distribution extent is extended over the spatial sector ρ, σ.

Generally, the suitable threshold parameter thr value can be obtained by inputting synthesized ambiance signals with different, known energy distribution into the analysis method, and monitoring the estimated ambiance energy distribution parameters with different threshold values. Moreover, audio signals synthesized with different ambiance energy distribution parameter values obtained at different threshold values can be listened, and the threshold can be selected based on the parameter values which give an audible perception closest to the original spatial audio field.

The above inspecting of the average ambient energy value and conditional inclusion into the ambiance distribution extent is then repeated for all neighbouring spatial sectors. After the neighbouring spatial sectors have been processed, the ambient energy distribution analyser may then repeat the above processing for those spatial sectors which fulfilled the above condition. The ambient energy distribution analyser may therefore again inspect the neighbour spatial sectors and extend the ambiance energy distribution to span over such spatial sectors which fulfil the above condition.

This extent determination terminates when no spatial sectors are remaining or no more spatial sectors fulfil the condition. As a result, the procedure returns a list of spatial sectors which have ambiance energy above the threshold. The extent of the ambiance energy distribution is defined such that it covers the found spatial sectors.

The determination of the extent of the ambient energy distribution is shown in FIG. 3 by step 309.

The extent of the ambient energy distribution then may be stored as shown in FIG. 3 by step 311.

The above procedure is able to find a continuous spatial sector of dominating ambient energy in a certain spatial sector (unimodal ambient energy distribution).

Figure 4:
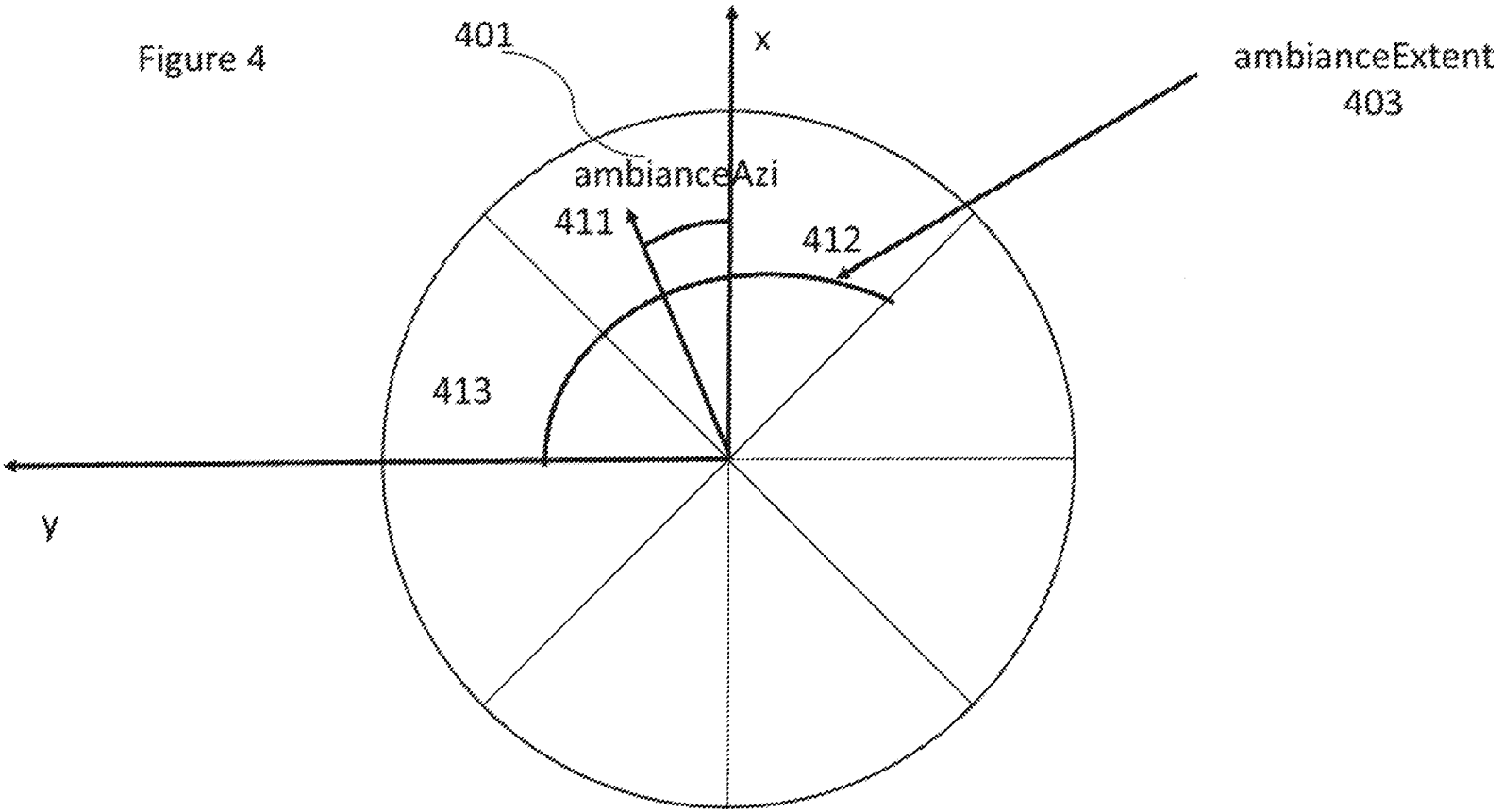
FIG. 4 shows an example of ambiance energy distribution parameters definitions according to some embodiments.

An example of this may be shown in FIG. 4 which shows the centre of the ambiance energy distribution defined by the ambianceAzi 401 vector within the sector 411. Furthermore is shown the extent of the ambient energy distribution defined by the ambianceExtent 403 angle, which in this example extends to the neighbouring sectors marked 412 and 413. In this example, ambianceAzi equals 45/2 degrees and ambianceExtent equals 135 degrees.

In some embodiments the ambient energy distribution analyser may optionally determine a second ambiance energy sector. This may be implemented in an example embodiment in such cases, where the spatial sector corresponding to the second largest ambient energy is sufficiently far from the spatial sector corresponding to the maximum energy. For example, if it is approximately at the opposite side of the spatial audio field. In this case, a second centre for the ambiance energy distribution can be defined as the direction corresponding to the second largest ambiance energy value. This second part of the ambiance energy distribution can also obtain an extent parameter in a manner similar to the first one. This enables the ambient energy distribution analyser to describe bimodal ambiance energy distributions, for example, audio sources at the opposite sides of the spatial audio field.

In some embodiments the ambient energy distribution analyser may be configured to output the following parameters (which are signalled to the decoder/synthesiser:

ambianceAzi: degrees (azimuth angle of the centre of the analysed ambiance energy distribution)

ambianceEle: degrees (elevation angle of the centre of the analysed ambiance energy distribution)

ambianceExtent: degrees (width of the analysed ambiance energy distribution)

In some embodiments there may be several of the above parameters, each describing a sector of substantial ambiance energy.

In some embodiments, there is a ratio parameter for each sector of the ambiance energy distribution parameters. The ratio parameter describes the ratio of the ambient energy in a sector to the total ambient energy (ambianceSectorEnergyRatio).

These parameters may be updated for every frame at the encoder. In some embodiments the parameters may be signalled at a lower rate (sent less frequently to the decoder/synthesiser). In some embodiments, very low update rates such as once per second can be sufficient. The slow update rate may ensure that the rendered spatial energy distribution does not change too rapidly.

In some embodiments where the input is in a loudspeaker input format, some embodiments may perform the analysis directly on the loudspeaker channels. In these embodiments rather than forming virtual cardioid signals the method can substitute the virtual cardioid signals c(k, n) directly with the input loudspeaker channels in a time-frequency domain.

Furthermore in some embodiments the input/processing may be implemented for higher order ambisonics (HOA) inputs. In these embodiments, instead of forming virtual cardioid signals the method can substitute the virtual cardioid signals c(k, n) with signals with one-sided directional patterns (or predominantly one-sided directional patterns) formed from zeroth to second or higher order HOA components, or any suitable means to generate signals with one-sided directional patterns from the HOA signals.

Figure 5:
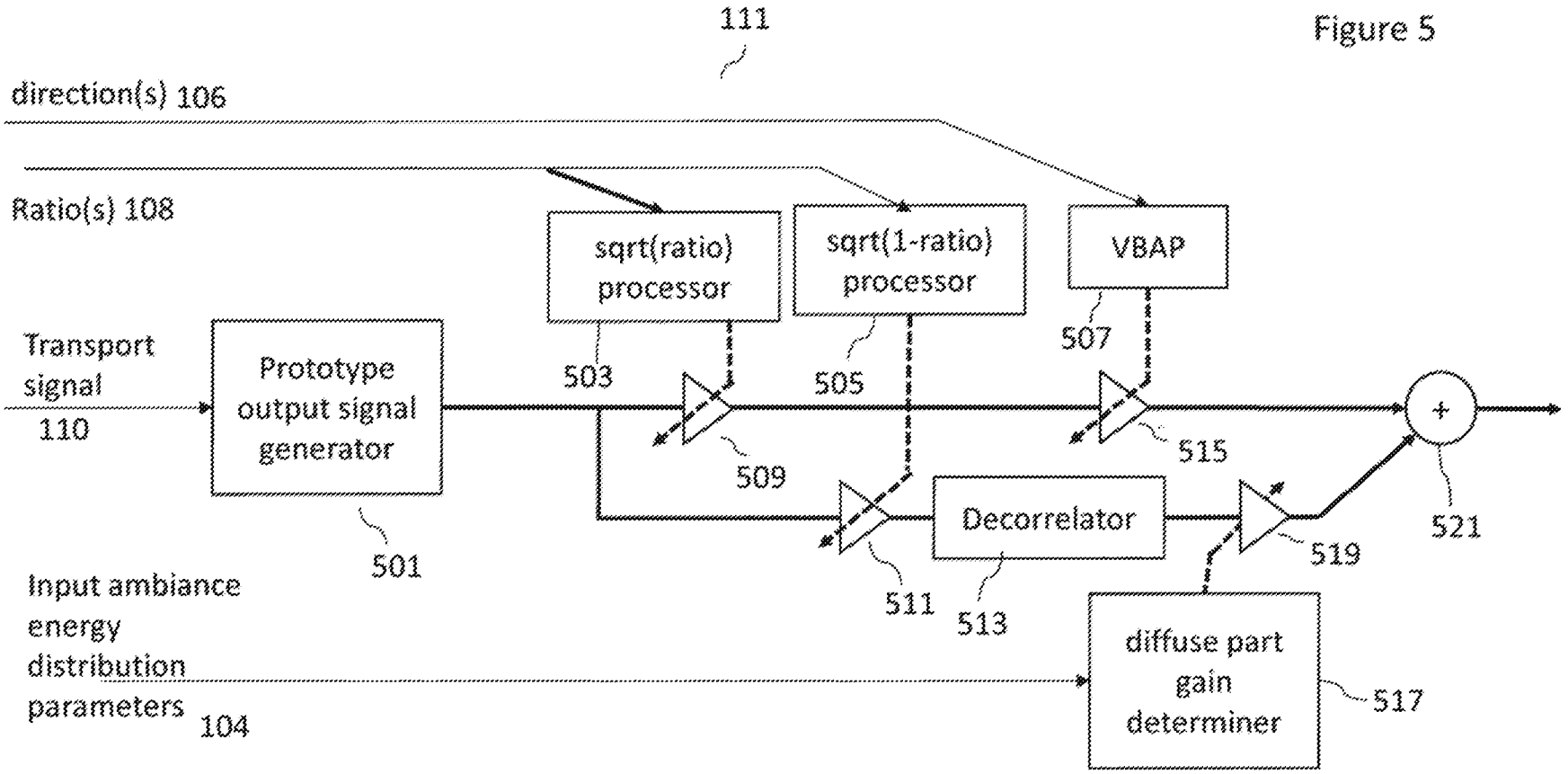
FIG. 5 shows schematically an example spatial synthesizer according to some embodiments.

With respect to FIG. 5 an example synthesizer 111 according to some embodiments is shown.

The inputs to the synthesizer 111 may in some embodiments be direction(s) 106, ratio(s) 108 spatial metadata, the transport audio signal stream 110 (which may have been decoded into a FOA signal) and the input ambiance energy distribution parameters 104. Further inputs to the system may be an enable/disable 550 input.

The prototype output signal generator 501 may be configured to receive the transport audio signal 110 and from this generate a prototype output signal. The transport audio signal stream 110 may be in the time domain and converted to a time-frequency domain before generating the prototype output signal. An example generation of a prototype signal from two transport signals may be by setting the left side prototype output channel(s) to be copies of the left transport channel, setting the right side prototype output channel(s) to be copies of the right transport channels, and the centre (or median) prototype channels to be a mix of the left and right transport channels. An example of the prototype output signal is a virtual microphone signal which attempts to regenerate a virtual microphone signal when the transport signal is actually a FOA signal.

A square root (ratio) processor 503 may receive the ratio(s) 108 and generate a square root of the value.

A first gain stage 509 (a direct signal generator) may receive the square root of the ratio(s) and apply this to the prototype output signal to generate the direct audio signal part.

A VBAP 507 is configured to receive the direction(s) 106 and generate suitable VBAP gains.

An example method generating VBAP gains may be based on 1) automatically triangulating the loudspeaker setup,
2) selecting appropriate triangle based on the direction (such that for a given direction three loudspeakers are selected which form a triangle where the given direction falls in), and
3) computing gains for the three loudspeakers forming the particular triangle.

In some embodiments VBAP gains (for each azimuth and elevation) and the loudspeaker triplets or other suitable numbers of loudspeakers or speaker nodes (for each azimuth and elevation) may be pre-formulated into a lookup table stored in the memory. In some embodiments a real-time method then performs the amplitude panning by finding from the memory the appropriate loudspeaker triplet (or number) for the desired panning direction, and the gains for these loudspeakers corresponding to the desired panning direction.

The first stage of VBAP is division of the 3D loudspeaker setup into triangles. There is no single solution to the generation of the triangulation and the loudspeaker setup can be triangulated in many ways. In some embodiments an attempt to try to find triangles or polygons of minimal size (no loudspeakers inside the triangles and sides having as equal length as possible). In a general case, this is a valid approach, as it treats auditory objects in any direction equally, and tries to minimize the distances to the loudspeakers that are being used to create the auditory object at that direction.

Another computationally fast method for the triangulation or virtual surface arrangement generation is to generate a convex hull as a function of the data points determined by the loudspeaker angles. This is also a generic approach that treats all directions and data points equally.

The next or second stage is to select the appropriate triangle or polygon or virtual surface corresponding to the panning directions.

The next stage is to formulate panning gains corresponding to the panning directions.

The direct part gain stage 515 is configured to apply the VBAP gains to the direct part audio signals to generate a spatially processed direct part.

A square root (1-ratio) processor 505 may receive the ratio(s) 108 and generate a square root of the 1-ratio value.

A second gain stage 511 (a diffuse signal generator) may receive the square root of the 1-ratio(s) and apply this to the prototype output signal to generate the diffuse audio signal part.

A decorrelator 513 is configured to receive the diffuse audio signal part from the second gain stage 511 and generate a decorrelated diffuse audio signal part.

A diffuse part gain determiner 517 may be configured to receive an enable/disable input and input ambiance energy distribution parameters 104. The enable/disable input may be configured to selectively enable or disable the following operations.

The diffuse part gain determiner 517 may be configured to selectively (based on the inputs) distribute the energy unevenly to different directions if the original spatial audio field has had an uneven distribution of ambient energy. The distribution of energy in the diffuse reproduction may therefore be closer to the original sound field.

A diffuse gain stage 519 may be configured to receive the diffuse part gains and apply them to the decorrelated diffuse audio signal part.

A combiner 521 may then be configured to combine the processed diffuse audio signal part and the processed direct signal part and generate suitable output audio signals. In some embodiments these combined audio signals may be further converted to a time domain form before output to a suitable output device.

Figure 6:
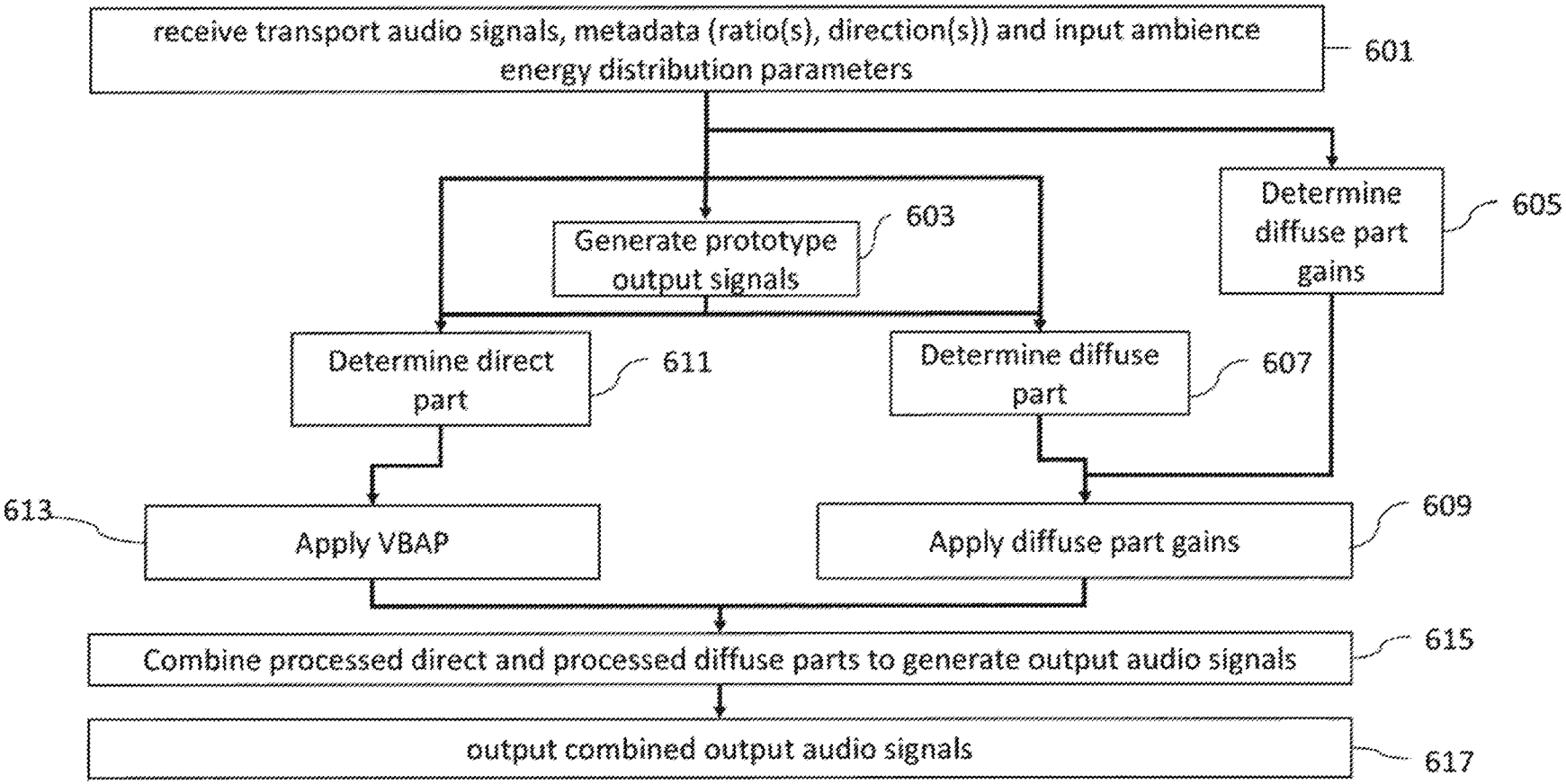
FIG. 6 shows a flow diagram of an example method of operating the example spatial synthesizer according to some embodiments.

With respect to FIG. 6 a flow diagram of the operations of the synthesizer 111 shown in FIG. 5 is shown.

The method may comprise receiving the transport audio signals, the metadata, (the enable/disable parameter) and input ambiance energy distribution parameters 104 as shown in FIG. 6 by step 601.

The method may also comprise generating the prototype output signal based on the transport audio signals as shown in FIG. 6 by step 603.

The method may also comprise determining the direct part from the prototype output signal and the ratio metadata as shown in FIG. 6 by step 611.

The method may also comprise determining the diffuse part from the prototype output signal and the ratio metadata as shown in FIG. 6 by step 607.

The application of VBAP to the direct part is shown in FIG. 6 by step 613.

The method may also comprise determining diffuse part gains based on the input ambiance energy distribution parameters 104 (and enable/disable parameter) as shown in FIG. 6 by step 605.

The method may further comprise applying the diffuse part gains to the determined diffuse part as shown in FIG. 6 by step 609.

The processed direct and diffuse parts may then be combined to generate the output audio signals as shown in FIG. 6 by step 615.

The combined output audio signals may then be output as shown in FIG. 6 by step 617.

Figure 7:
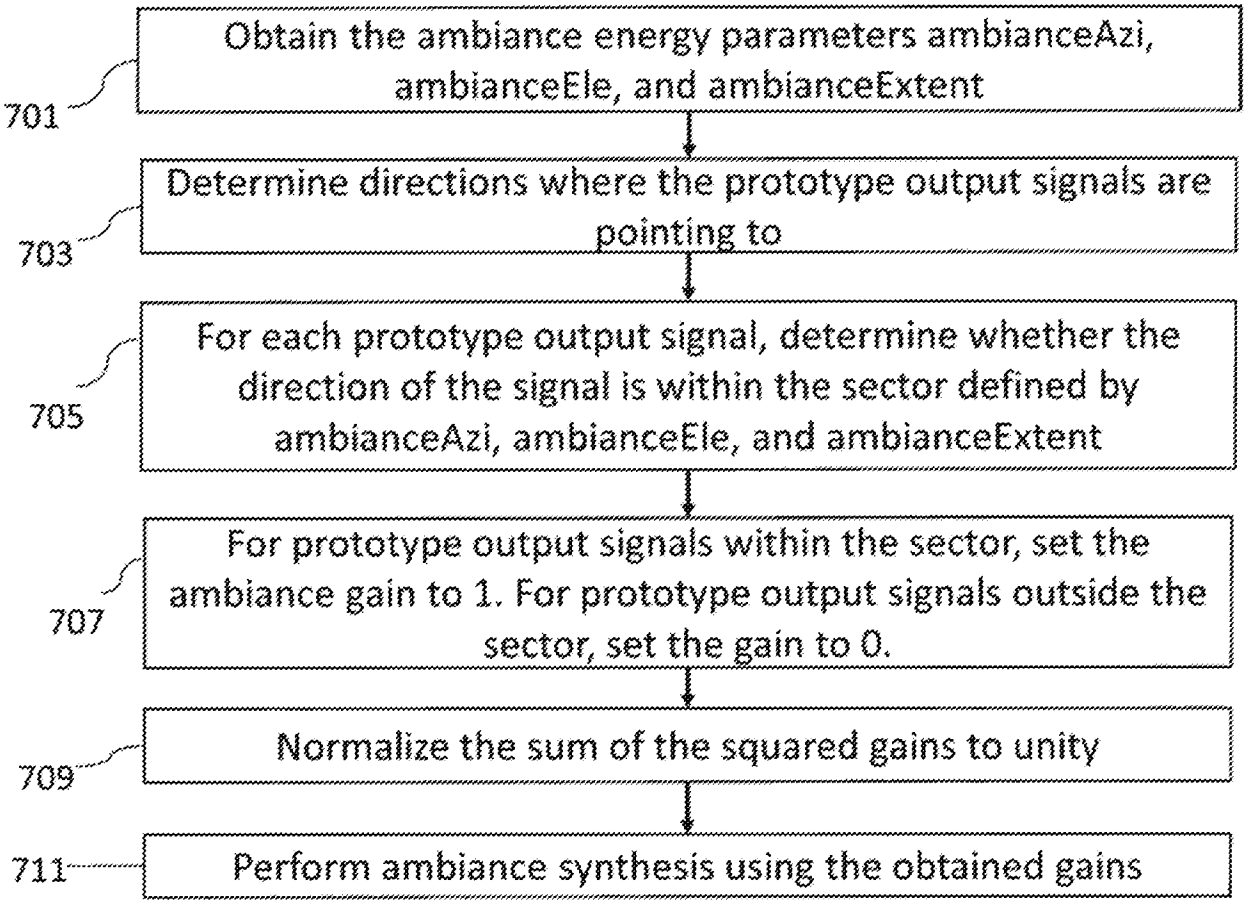
FIG. 7 shows a flow diagram of an example method of determining diffuse stream gains based on the ambiance energy distribution parameters.

With respect to FIG. 7 a flow diagram of the operation of an example diffuse part gain determiner 605 according to some embodiments is shown.

The example diffuse part gain determiner 605 may be configured to receive/obtain the input ambiance energy distribution parameters 104, for example the ambianceAzi, ambianceEle and ambianceExtent parameters described earlier as shown in FIG. 7 by step 701.

In some embodiments the example diffuse part gain determiner 605 may then be configured to determine directions associated with the prototype output signals. In the case of loudspeaker synthesis, the prototype output signals are associated with the direction of each output loudspeaker. In the case of binaural synthesis, the prototype output signals may be created with associated directions to fill the spatial audio field uniformly and/or with constant spacing.

The determination of where the directions associated with the prototype outputs are pointing to is shown in FIG. 7 by step 703.

The diffuse part gain determiner 605 may then for each prototype output signal determine whether the direction of the prototype signal (or virtual microphone) is within a received sector of the ambiance energy distribution.

For example, for an ambiance energy distribution of (azimuth 0, elevation 0) and extent 90 degrees, the spatial positions from (azimuth 45, elevation 0) to (azimuth −45, elevation 0) are within the ambiance energy distribution.

The determination of whether the direction of the prototype output signal is within a sector of the ambiance energy distribution is shown in FIG. 7 by step 705.

The diffuse part gain determiner 605 may then be configured to set a gain value of 1 for any prototype output signal within the distribution and set a gain value of 0 for any prototype output signal outside the distribution. More generally the diffuse part gain determiner may be configured to set gains associated with prototype output signal within the sector to be on average larger than the gains associated with virtual microphone signals outside the sector.

The setting of the gain values is shown in FIG. 7 by step 707.

The sum of the squared gains may be then normalised to unity as shown in FIG. 7 by step 709.

These gains may then be passed to the diffuse gain stage 519 which is configured to perform ambiance synthesis using the obtained gains as shown in FIG. 7 by step 711.

Thus, the effect of the above synthesis is that a reduced ambient energy or no ambient energy is synthesized towards the directions which are outside the received ambiance energy distribution.

If the ambiance energy distribution parameters contain the ambiance energy ratio parameter, the ambiance energy is synthesized in suitable energy ratios to the different sectors.

Figure 8:
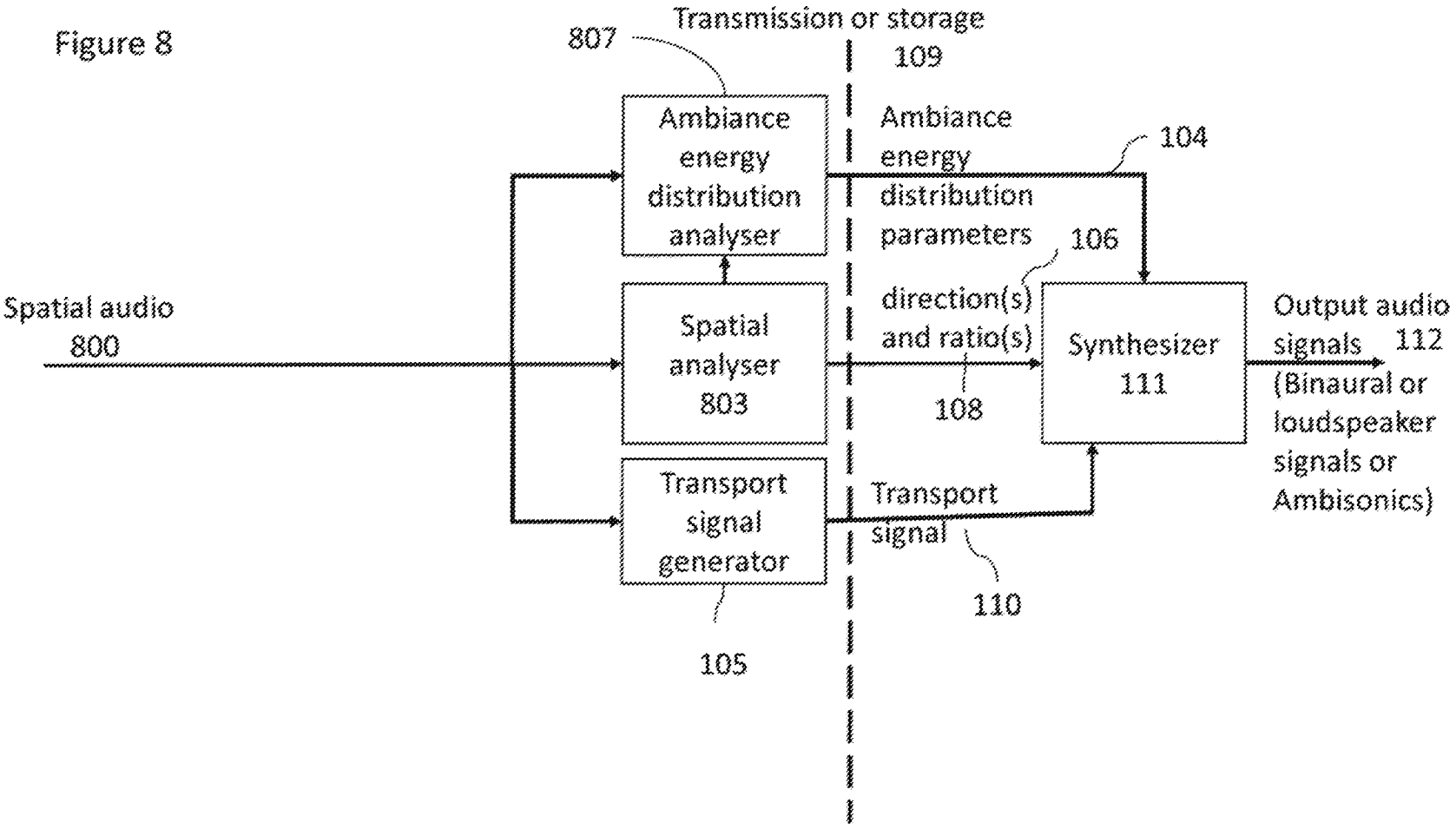
FIG. 8 shows schematically a further example spatial capture and synthesizer according to some embodiments.

In some embodiments, there is no conversion to a common format such as FOA for different spatial audio input formats, but rather the spatial audio is input to the spatial analysis, ambiance energy distribution analysis and transmit signal generation. This is depicted in FIG. 8. The input spatial audio 800 can be in loudspeaker input format, Ambisonics (FOA or HOA), multi-microphone format, that is, the output signals of a microphone array, or already in parametric format with directional and ratio metadata analyzed by spatial audio capture means. In the case the input is already in parametric format, the spatial analyser 803 may not perform anything, or it may just perform conversions from one parametric representation to another. If the input is not in parametric format then the spatial analyser 803 may be configured to perform spatial analysis to derive the directional and ratio metadata. The ambiance energy distribution analyser 807 determines the parameters to represent the distribution of the ambiance energy. The determination of the parameters for the ambiance energy distribution can be different for different input formats. In some cases, the determination can be based on analyzing ambient energy at different input channels. It can be based on forming signals with one-sided directional patterns from components of the input spatial audio. Signals with one-sided directional patterns could be obtained with beamforming or any suitable means.

The synthesis described herein can also be integrated with covariance matrix based synthesis. The covariance matrix based synthesis refers to a least-squares optimized signal mixing technique to manipulate the covariance matrix of a signal, while well preserving the audio quality. The synthesis utilizes the covariance matrix measure of the input signal and a target covariance matrix (determined by the desired output signal characteristics), and provides a mixing matrix to perform such processing.

The key information that needs then to be determined is the mixing matrix in frequency bands, which is formulated based on the input and target covariance matrices in frequency bands. The input covariance matrix is measured from the input signal in frequency bands, and the target covariance matrix is formulated as the sum of ambiance part covariance matrix and the direct part covariance matrix. The diagonal entries of the ambiance part covariance matrix are created such that the entries corresponding to spatial directions inside the ambiance distribution are set to unity and other entries to zero. The diagonal entries are then normalized so that they sum to unity. In some embodiments the energy within sectors is increased and energy outside sector reduced, and then normalized so that they sum to unity The direction of the centre of the analysed ambiance energy distribution can alternatively be signalled using a similar direction index for a spherical surface grid as defined for the directionality information. For example, the indexing of the source direction can be obtained by forming a fixed grid of small spheres on a larger sphere and considering the centres of the small spheres as points defining a grid of almost equidistant directions. The width or extent of the ambiance energy distribution can be represented in radians instead of degrees, and quantized to a suitable resolution. Alternatively, the width or extent can be represented as a number indicating how many spatial sectors of fixed width it covers. For example, in the example of FIG. 4 the ambianceExtent could have a value of 3 indicating that it spans over three sectors of 45 degrees each. In some embodiments, the ambianceExtent information can comprise an additional parameter ambianceExtentSector which indicates the size of the analysis sector for ambiance energy distribution analysis. Thus, in the example of FIG. 4 ambianceAnalysisSectorWidth can have a value of 45 degrees. Signalling the span of the ambiance analysis sector enables the encoder to use different size sectors for the ambiance energy analysis. Adapting the size of the ambiance energy analysis sector can be advantageous for adjusting the system operation for sound fields with different ambiance properties and for adjusting the bandwidth and computational complexity requirements of the encoder and/or decoder.

Figure 9:
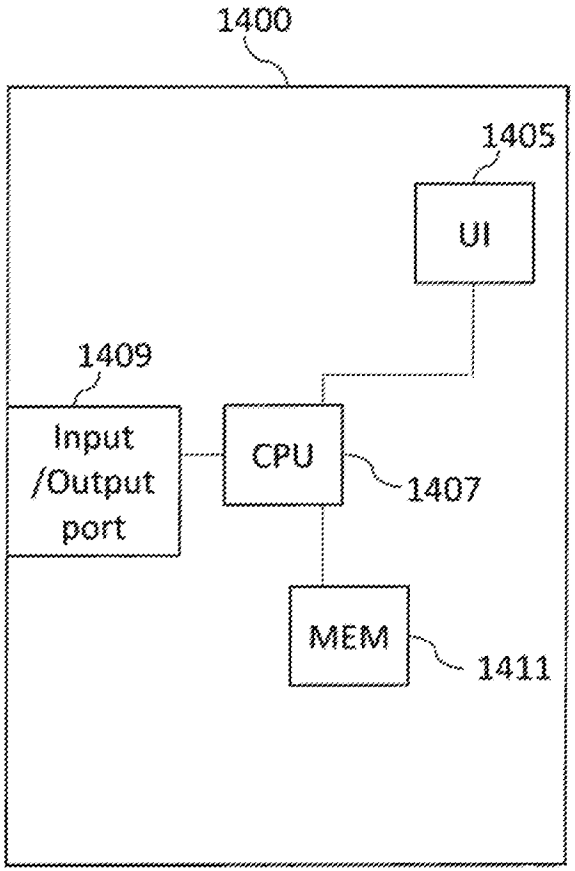
FIG. 9 shows schematically an example device suitable for implementing the apparatus shown.

With respect to FIG. 9 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1400 comprises at least one processor or central processing unit 1407. The processor 1407 can be configured to execute various program codes such as the methods such as described herein.

In some embodiments the device 1400 comprises a memory 1411. In some embodiments the at least one processor 1407 is coupled to the memory 1411. The memory 1411 can be any suitable storage means. In some embodiments the memory 1411 comprises a program code section for storing program codes implementable upon the processor 1407. Furthermore in some embodiments the memory 1411 can further comprise a stored data section for storing data, for example data that has been processed or to be processed in accordance with the embodiments as described herein. The implemented program code stored within the program code section and the data stored within the stored data section can be retrieved by the processor 1407 whenever needed via the memory-processor coupling.

In some embodiments the device 1400 comprises a user interface 1405. The user interface 1405 can be coupled in some embodiments to the processor 1407. In some embodiments the processor 1407 can control the operation of the user interface 1405 and receive inputs from the user interface 1405. In some embodiments the user interface 1405 can enable a user to input commands to the device 1400, for example via a keypad. In some embodiments the user interface 1405 can enable the user to obtain information from the device 1400. For example the user interface 1405 may comprise a display configured to display information from the device 1400 to the user. The user interface 1405 can in some embodiments comprise a touch screen or touch interface capable of both enabling information to be entered to the device 1400 and further displaying information to the user of the device 1400.

In some embodiments the device 1400 comprises an input/output port 1409. The input/output port 1409 in some embodiments comprises a transceiver. The transceiver in such embodiments can be coupled to the processor 1407 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1409 may be configured to receive the signals and in some embodiments determine the parameters as described herein by using the processor 1407 executing suitable code. Furthermore the device may generate a suitable transport signal and parameter output to be transmitted to the synthesis device.

In some embodiments the device 1400 may be employed as at least part of the synthesis device. As such the input/output port 1409 may be configured to receive the transport signals and in some embodiments the parameters determined at the capture device or processing device as described herein, and generate a suitable audio signal format output by using the processor 1407 executing suitable code. The input/output port 1409 may be coupled to any suitable audio output for example to a multichannel speaker system and/or headphones or similar.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

As used in this application, the term "circuitry" may refer to one or more or all of the following:

(a) hardware-only circuit implementations (such as implementations in only analogue and/or digital circuitry) and (b) combinations of hardware circuits and software, such as (as applicable):

(i) a combination of analogue and/or digital hardware circuit(s) with software/firmware and (ii) any portions of hardware processor(s) with software (including digital signal processor(s)), software, and memory(ies) that work together to cause an apparatus, such as a mobile phone or server, to perform various functions) and (c) hardware circuit(s) and or processor(s), such as a microprocessor(s) or a portion of a microprocessor(s), that requires software (e.g., firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus for spatial audio signal decoding, the apparatus comprising at least one processor and at least one non-transitory memory including a computer program code, the at least one memory and the computer program code configured to, with the at least one processor, cause the apparatus at least to:

receive:

at least one associated audio signal, the at least one associated audio signal based on a spatial audio signal, and spatial metadata associated with the at least one associated audio signal, the spatial metadata comprising at least one parameter representing an ambiance energy distribution of the spatial audio signal and at least one directional parameter representing directional information of the spatial audio signal, wherein the at least one parameter representing the ambience energy distribution is associated with, at least, a respective energy of ambient sound in a plurality of directions; and synthesize from the at least one associated audio signal at least one output audio signal based on the at least one directional parameter and the at least one parameter, wherein the at least one parameter controls ambiance energy distribution of the at least one output signal.

2. The apparatus as claimed in claim 1, wherein the apparatus is further caused to:

divide the at least one associated audio signal into a direct part and diffuse part based on the spatial metadata;

synthesize a direct audio signal based on the direct part of the at least one associated audio signal and the at least one directional parameter;

determine a diffuse part gains based on the at least one parameter representing the ambiance energy distribution of the spatial audio signal;

synthesize a diffuse audio signal based on the diffuse part of the at least one associated audio signal and the diffuse part gains; and combine the direct audio signal and the diffuse audio signal to generate the at least one output audio signal.

3. The apparatus as claimed in claim 2, wherein the apparatus is further caused to decorrelate the at least one associated audio signal.

4. The apparatus as claimed in claim 2, wherein the apparatus is further caused to:

determine directions to which a set of prototype output signals respectively point;

for respective ones of the set of prototype output signals, determine whether a direction of a respective prototype output signal is within a sector defined with the at least one parameter representing the ambiance energy distribution of the spatial audio signal; and set gains associated with prototype output signals of the set of prototype output signals, that are within the sector, to be on average larger than gains associated with prototype output signals of the set of prototype output signals that are outside the sector.

5. The apparatus as claimed in claim 4, wherein the apparatus is further caused to:

set the gains associated with the prototype output signals within the sector to 1;

set the gains associated with the prototype output signals outside the sector to 0; and normalise a sum of squares of the gains associated with the prototype output signals within the sector and the prototype output signals outside the sector to be unity.

6. The apparatus as claimed in claim 1, wherein the apparatus is further caused to at least one of:

analyse the spatial audio signal to determine the at least one parameter representing the ambiance energy distribution of the spatial audio signal; or receive the at least one parameter representing the ambiance energy distribution of the spatial audio signal.

7. The apparatus as claimed in claim 1, wherein the at least one directional parameter comprises at least one of:

at least one direction parameter representing a direction of arrival;

a diffuseness parameter associated with the at least one direction parameter; or an energy ratio parameter associated with the at least one direction parameter.

8. The apparatus as claimed in claim 1, wherein the at least one parameter is at least one of:

a first parameter comprising at least one azimuth angle and/or at least one elevation angle associated with at least one spatial sector with a local largest average ambient energy; or at least one further parameter based on an extent angle of the at least one spatial sector with the local largest average ambient energy.

9. The apparatus as claimed in claim 1, wherein the at least one parameter is a parameter represented on a frequency band by frequency band basis.

10. An apparatus for spatial audio signal processing, the apparatus comprising at least one processor and at least one non-transitory memory including a computer program code, the at least one memory and the computer program code configured to, with the at least one processor, cause the apparatus at least to:

receive at least one spatial audio signal;

determine from the at least one spatial audio signal at least one associated audio signal;

determine spatial metadata associated with the at least one associated audio signal, wherein the spatial metadata comprises at least one parameter representing an ambiance energy distribution of the at least one spatial audio signal, and at least one directional parameter representing directional information of the at least one spatial audio signal, wherein the at least one parameter representing the ambience energy distribution is associated with, at least, a respective energy of ambient sound in a plurality of directions; and transmit and/or store: the at least one associated audio signal, and the spatial metadata comprising the at least one parameter representing the ambiance energy distribution of the at least one spatial audio signal and the at least one directional parameter representing the directional information of the at least one spatial audio signal.

11. The apparatus as claimed in claim 10, wherein the apparatus is further caused to:

form directional pattern filtered signals based on the at least one spatial audio signal to several spatial directions defined with an azimuth angle and/or an elevation angle;

determine a weighted temporal average of ambient energy per spatial sector based on the directional pattern filtered signals;

determine at least one spatial sector with a local largest average ambient energy and generate a first parameter comprising at least one azimuth angle and/or at least one elevation angle associated with the at least one spatial sector with the local largest average ambient energy;

determine an extent angle of the local largest average ambient energy based on a comparison of average ambient energy of neighbouring spatial sectors to the local largest average ambient energy; and generate at least one further parameter based on the extent angle of the at least one spatial sector with the local largest average ambient energy.

12. The apparatus as claimed in claim 11, wherein the apparatus is further caused to form virtual cardioid signals defined with the azimuth angle and/or the elevation angle.

13. The apparatus as claimed in claim 10, wherein the apparatus is further caused to determine the spatial metadata on a frequency band by frequency band basis.

14. A method for spatial audio signal decoding, the method comprising:

receiving:

at least one associated audio signal, the at least one associated audio signal based on a spatial audio signal, and spatial metadata associated with the at least one associated audio signal, the spatial metadata comprising at least one parameter representing an ambiance energy distribution of the spatial audio signal and at least one directional parameter representing directional information of the spatial audio signal, wherein the at least one parameter representing the ambience energy distribution is associated with, at least, a respective energy of ambient sound in a plurality of directions; and synthesizing from the at least one associated audio signal at least one output audio signal based on the at least one directional parameter and the at least one parameter, wherein the at least one parameter controls ambiance energy distribution of the at least one output signal.

15. The method as claimed in claim 14, wherein synthesizing the at least one output audio signal comprises:

dividing the at least one associated audio signal into a direct part and diffuse part based on the spatial metadata;

synthesizing a direct audio signal based on the direct part of the at least one associated audio signal and the at least one directional parameter;

determining a diffuse part gains based on the at least one parameter representing the ambiance energy distribution of the spatial audio signal;

synthesizing a diffuse audio signal based on the diffuse part of the at least one associated audio signal and the diffuse part gains; and combining the direct audio signal and the diffuse audio signal to generate the at least one output audio signal.

16. A method for spatial audio signal processing, the method comprising:

receiving at least one spatial audio signal;

determining from the at least one spatial audio signal at least one associated audio signal;

determining spatial metadata associated with the at least one associated audio signal, wherein the spatial metadata comprises at least one parameter representing an ambiance energy distribution of the at least one spatial audio signal, and at least one directional parameter representing directional information of the at least one spatial audio signal, wherein the at least one parameter representing the ambience energy distribution is associated with, at least, a respective energy of ambient sound in a plurality of directions; and transmitting and/or storing: the at least one associated audio signal, and the spatial metadata comprising the at least one parameter representing the ambiance energy distribution of the at least one spatial audio signal and the at least one directional parameter representing the directional information of the at least one spatial audio signal.

17. The method as claimed in claim 14, wherein receiving the spatial metadata is comprising performing at least one of:

analysing the spatial audio signal for determining the at least one parameter representing the ambiance energy distribution of the spatial audio signal; or receiving the at least one parameter representing the ambiance energy distribution of the spatial audio signal.

18. The method as claimed in claim 16, wherein determining the spatial metadata further comprising:

forming directional pattern filtered signals based on the at least one spatial audio signal to several spatial directions defined with an azimuth angle and/or an elevation angle;

determining a weighted temporal average of ambient energy per spatial sector based on the directional pattern filtered signals;

determining at least one spatial sector with a local largest average ambient energy and generating a first parameter comprising at least one azimuth angle and/or at least one elevation angle associated with the at least one spatial sector with the local largest average ambient energy;

determining an extent angle of the local largest average ambient energy based on a comparison of average ambient energy of neighboring spatial sectors to the local largest average ambient energy; and generating at least one further parameter based on the extent angle of the at least one spatial sector with the local largest average ambient energy.

19. The method as claimed in claim 18, wherein forming the directional pattern filtered signals is comprising forming virtual cardioid signals defined with the azimuth angle and/or the elevation angle.

20. The method as claimed in claim 16, wherein determining the spatial metadata is further comprising determining the spatial metadata on a frequency band by frequency band basis.

* * * * *